US007064726B2

(12) United States Patent
Kitamori et al.

(10) Patent No.: US 7,064,726 B2
(45) Date of Patent: Jun. 20, 2006

(54) ANTENNA DEVICE AND TRANSMITTING/RECEIVING DEVICE

(75) Inventors: Nobumasa Kitamori, Yokohama (JP); Tomohiro Nagai, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/526,448

(22) PCT Filed: Aug. 13, 2003

(86) PCT No.: PCT/JP03/10282

§ 371 (c)(1),
(2), (4) Date: Mar. 2, 2005

(87) PCT Pub. No.: WO2004/027926

PCT Pub. Date: Apr. 1, 2004

(65) Prior Publication Data

US 2005/0270247 A1 Dec. 8, 2005

(30) Foreign Application Priority Data

Sep. 20, 2002 (JP) ..... 2002-275488

(51) Int. Cl.
*H01Q 13/00* (2006.01)
*H01Q 13/10* (2006.01)

(52) U.S. Cl. ..... 343/771; 343/786; 333/21

(58) Field of Classification Search ..... 343/771, 343/786; 333/21, 107, 108
See application file for complete search history.

(56) References Cited

U.S. PATENT DOCUMENTS 2,427,005 A 9/1947 King
4,574,289 A * 3/1986 Henderson ..... 343/786
5,463,358 A * 10/1995 Dunn et al. ..... 333/1
6,067,390 A * 5/2000 Hames et al. ..... 385/23
6,246,298 B1 6/2001 Ishikawa et al.

FOREIGN PATENT DOCUMENTS

| | | |
|---|---|---|
| EP | 1 291 965 A1 | 3/2003 |
| JP | 56-104201 | 8/1981 |
| JP | 64-51302 | 3/1989 |
| JP | 05-048316 | 2/1993 |
| JP | 06-334426 | 12/1994 |
| JP | 6-350326 | 12/1994 |

(Continued)

OTHER PUBLICATIONS

Official Communication issued in the corresponding Japanese Application No. 2002-275488, dated Jan. 17, 2006.

*Primary Examiner*—Tan Ho
(74) *Attorney, Agent, or Firm*—Keating & Bennett, LLP

(57) ABSTRACT

An antenna apparatus includes two circular waveguides including a fixed-side circular waveguide and a rotation-side circular waveguide, each having a propagation mode in a TM01 mode, and being arranged coaxially with each other while a waveguide-side choke is provided between the two waveguides. A rectangular waveguide is connected to the fixed-side circular waveguide. Thereby, the high-frequency signal fed from the rectangular waveguide to the fixed-side circular waveguide can be radiated from a primary radiator to which the rotation-side circular waveguide is connected. While the circular waveguides and the waveguide-side choke can constitute a rotary joint, by rotating the primary radiator together with the rotation-side circular waveguide, scanning can be carried out with a high-frequency signal radiated from the primary radiator.

17 Claims, 26 Drawing Sheets

FOREIGN PATENT DOCUMENTS

| | | |
|---|---|---|
| JP | 08-078936 | 3/1996 |
| JP | 10-300848 | 11/1998 |
| JP | 11-017440 | 1/1999 |
| JP | 11-027036 | 1/1999 |
| JP | 11-038132 | 2/1999 |
| JP | 11-127001 | 5/1999 |
| JP | 2001-217634 | 8/2001 |
| WO | WO 2002/071539 | 9/2002 |

* cited by examiner

ANTENNA DEVICE AND TRANSMITTING/RECEIVING DEVICE

This application is a 371 of PCT/JP03/10282 filed Aug. 13, 2003.

BACKGROUND OF THE INVENTION

1. Field of the Invention

The present invention relates to an antenna apparatus that is suitable for use in scanning with high-frequency electromagnetic waves (high-frequency signals), such as micro waves and millimeter waves, over a predetermined angular range, and a transmitter/receiver, such as a radar and a communication apparatus, including such an antenna apparatus.

2. Description of the Related Art

In general, various kinds of beam-scanning antenna apparatuses used for an on-vehicle radar, for example, are known. For example, a first conventional technique involves the use of a reciprocal first dielectric line and a second fixed dielectric line which constitute a directional coupler, and the first dielectric line has a primary radiator connected to move with the reciprocal first dielectric line (Japanese Unexamined Patent Application Publication No. 2001-217634, for example).

Also, a second conventional technique involves the use of a reflection plate for reflecting a beam radiated from the primary radiator, which reflection plate is rotated in accordance with the beam scanning angle using a rotation mechanism, and an antenna transmitter/receiver including the primary radiator is capable of beam scanning using a cam mechanism or a link mechanism (Japanese Unexamined Patent Application Publication No. 11-27036, Japanese Unexamined Patent Application Publication No. 11-38132, for example).

Furthermore, a third conventional technique involves a dielectric disc provided in front of a transmitter/receiver antenna having thicknesses that differ with a circumferential angle, being rotated, and a hollow dielectric cylinder with an inclined axis arranged around a waveguide slot array being rotated (Japanese Unexamined Patent Application Publication No. 10-300848, Japanese Unexamined Patent Application Publication No. 6-334426, for example).

However, in the antenna apparatus according to the first conventional technique mentioned above, in addition to the necessity for a reciprocal mechanism, such as a linear motor, for reciprocating the primary radiator, etc., it is necessary to accelerate/decelerate the primary radiator, etc., along with the reciprocation of the primary radiator, so that the increased mechanical load on the reciprocal mechanism becomes a problem.

Also, in the second conventional technique, the cam mechanism and the link mechanism required for beam scanning are mechanically complicated, so that the entire antenna apparatus is liable to increase in size, and the layout of the entire antenna apparatus is complicated because of the arrangement of the cam mechanism, thereby increasing manufacturing cost.

Furthermore, in the third technique, by rotating the dielectric disc or the dielectric cylinder, the direction of a beam passing through the dielectric cylinder is changed. However, since the direction of the primary radiator is not directly changed, the dielectric cylinder tends to increase in size. Hence, there arises a problem in that the load on a motor or the like for rotating the dielectric cylinder is increased, thereby reducing reliability and durability.

SUMMARY OF THE INVENTION

In order to overcome the problems described above, preferred embodiments of the present invention provide an antenna apparatus and a transmitter/receiver capable of reducing a mechanical load as well as manufacturing cost by simplifying a structure.

An antenna apparatus according to a preferred embodiment of the present invention includes a fixed-side transmission line having an electric field distribution or a magnetic field distribution that is axially symmetrical in a propagating direction, a rotation-side transmission line, having an axially symmetrical electric field distribution or magnetic field distribution, arranged coaxially with the fixed-side transmission line so as to be rotatable about the axis of the fixed-side transmission line, a transmission-line side choke disposed between the fixed-side transmission line and the rotation-side transmission line for causing a short-circuit between both the lines at a high frequency, and a primary radiator disposed in the rotation-side transmission line so as to be rotatable together with the rotation-side transmission line for radiating high-frequency signals that have passed through the rotation-side transmission line in a direction that is different from that of the rotation axis of the rotation-side transmission line.

With such a unique structure and arrangement, the fixed-side transmission line is arranged coaxially with the rotation-side transmission line, and both the lines have an axially symmetrical electric field distribution or magnetic field distribution, so that high-frequency signals in the same mode can be propagated through the fixed-side transmission line and the rotation-side transmission line regardless of the rotational displacement of the rotation-side transmission line. Between the fixed-side transmission line and the rotation-side transmission line, the transmission-line side choke is provided, so that both the lines can be choke-coupled together and short-circuited at a high-frequency via the transmission-line side choke so as to prevent the high-frequency signal from leaking from the gap between both the lines.

Furthermore, the rotation-side transmission line is provided with the primary radiator radiating high-frequency signals in a direction that is different from the rotation axis, so that by using the primary radiator, the high-frequency signal can be radiated in a direction such as a substantially perpendicular direction and a direction inclined by a predetermined angle relative to the radiating direction of the rotation-side transmission line. Also, since the primary radiator is rotated together with the rotation-side transmission line, the entire circumstance can be scanned with high-frequency signals about the rotation axis while the high-frequency signals can be radiated over an arbitrary angular range through the primary radiator by blocking an unnecessary radiation range as long as the range is within 360° (whole circumference). When the antenna apparatus according to a preferred embodiment of the present invention is applied to a radar, for example, while wide angle detection is possible over the whole circumference, angular resolution can be improved because of the detection at an arbitrary angle.

According to a preferred embodiment of the present invention, a plurality of the primary radiators are provided in the rotation-side transmission line, and the plurality of the primary radiators are arranged to be directed in directions that are different from each other.

Therefore, a plurality of primary radiators can be radially arranged about the rotation axis. At this time, when the primary radiators directed in a predetermined direction in the plurality of rotating primary radiators are radiated while residual primary radiators are blocked, while the rotation-side transmission line is making one revolution, a plurality of the primary radiators are directed in a predetermined direction. As a result, in comparison with the single primary radiator attached thereto, a period of time radiating the high-frequency signals in a predetermined direction within one revolution can be increased so as to increase the detection period and communication period.

Moreover, according to a preferred embodiment of the present invention, a casing is arranged around the plurality of the primary radiators for surrounding the primary radiators, and the casing is provided with a radiator opening formed thereon, to which any one of the plurality of rotating primary radiators is sequentially connected.

Thereby, while high-frequency signals are radiated through the radiator opening of the casing from one primary radiator sequentially connected thereto, residual primary radiators are surrounded by the casing so that the radiation of the high-frequency signals can be blocked. Since while the rotation-side transmission line is making one revolution, a plurality of the primary radiators are sequentially connected to the radiator opening, in comparison with the single primary radiator attached thereto, a period of time radiating the high-frequency signals through the radiator opening within one revolution of the rotation-side transmission line can be increased so as to increase the detection period and communication period.

Moreover, according to a preferred embodiment of the present invention, a radiator-side choke is provided between the plurality of primary radiators and the casing, and when one of the primary radiators is connected to the radiator opening, the residual primary radiators and the casing are shorted therebetween by the radiator-side choke at high frequency.

Thereby, while one primary radiator is radiating high-frequency signals through the radiator opening, the high-frequency signals can be prevented from leaking through between the residual primary radiators and the casing, so that the loss of the entire antenna apparatus can be minimized.

According to a preferred embodiment of the present invention, an antenna apparatus includes a fixed-side transmission line having an electric field distribution or a magnetic field distribution axially symmetrical in a propagating direction, a rotation-side transmission line, having an axially symmetrical electric field distribution or magnetic field distribution, arranged coaxially with the fixed-side transmission line so as to be rotatable about the axis of the fixed-side transmission line, a transmission-line side choke disposed between the fixed-side transmission line and the rotation-side transmission line for causing a short-circuit between both the lines at a high frequency, and a primary radiator disposed in the rotation-side transmission line so as to be rotatable together with the rotation-side transmission line for radiating high-frequency signals that have passed through the rotation-side transmission line in parallel with the rotation axis of the rotation-side transmission line not coaxially with the rotation axis.

As a result, the fixed-side transmission line is choke-coupled with the rotation-side transmission line using the transmission-line side choke, so that high-frequency signals can be propagated through the two transmission lines. Also, the rotation-side transmission line is provided with the primary radiator capable of radiating high-frequency signals in parallel with the rotation axis not coaxially with the rotation axis, so that the radiation position of the high-frequency signal can be moved about the rotation axis as a center by rotating the primary radiator together with the rotation-side transmission line.

According to a preferred embodiment of the present invention, a secondary radiator is arranged on the line of the radiating direction of the primary radiator, and the secondary radiator changes an outgoing radiation direction in accordance with an incident position of high-frequency signals.

As a result, by rotating the primary radiator together with the rotation-side transmission line, the incident position of high-frequency signals can be moved relative to the secondary radiator made of a dielectric lens, a bifocal lens, or a parabola reflector so as to change the outgoing direction of the high-frequency signal emitted from the secondary radiator. As a result, scanning can be carried out laterally on a horizontal plane or scanning can be performed in a conical shape with a beam.

According to a preferred embodiment of the present invention, the respective fixed-side transmission line and the rotation-side transmission line preferably include a circular waveguide having a propagation mode in a TM01 mode as the magnetic field distribution that is axially symmetrical about the propagating direction.

As a result, the fixed-side transmission line or the rotation-side transmission line can be easily connected to a rectangular waveguide in the TE10 mode, for example, so as to easily feed high-frequency signals to the fixed-side transmission line while the rotation-side transmission line can be readily connected to the primary radiator such as a horn antenna.

Also, a transmitter/receiver, such as a radar and a communication apparatus, may be constructed using the antenna apparatus according to a preferred embodiment of the present invention.

Other features, elements, steps, characteristics and advantages of the present invention will become more apparent from the following detailed description of preferred embodiments thereof with reference to the attached drawings.

DETAILED DESCRIPTION OF PREFERRED EMBODIMENTS

Figure 1:
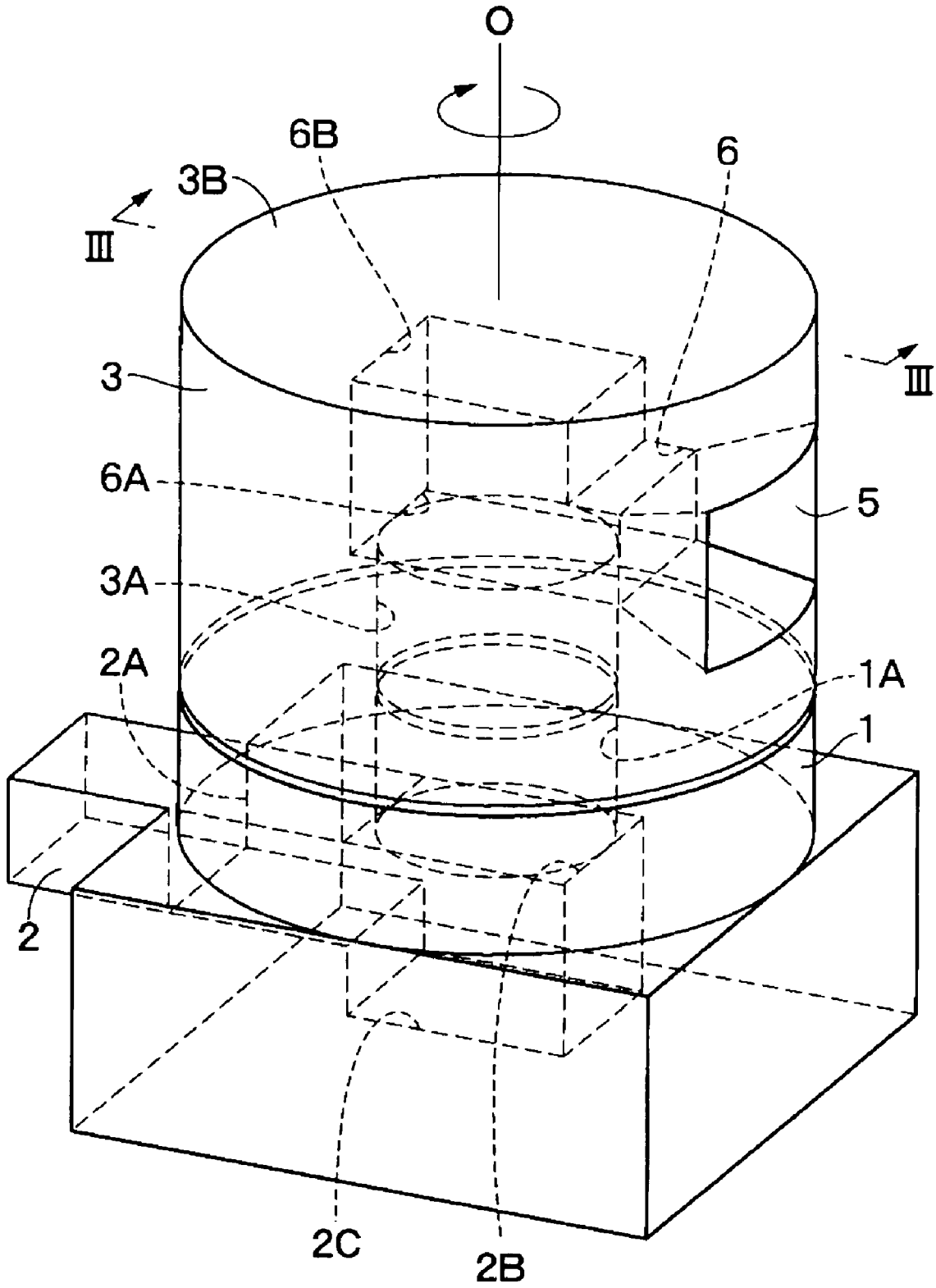
FIG. 1 is a perspective view of an antenna apparatus according to a first preferred embodiment of the present invention.
Figure 2:
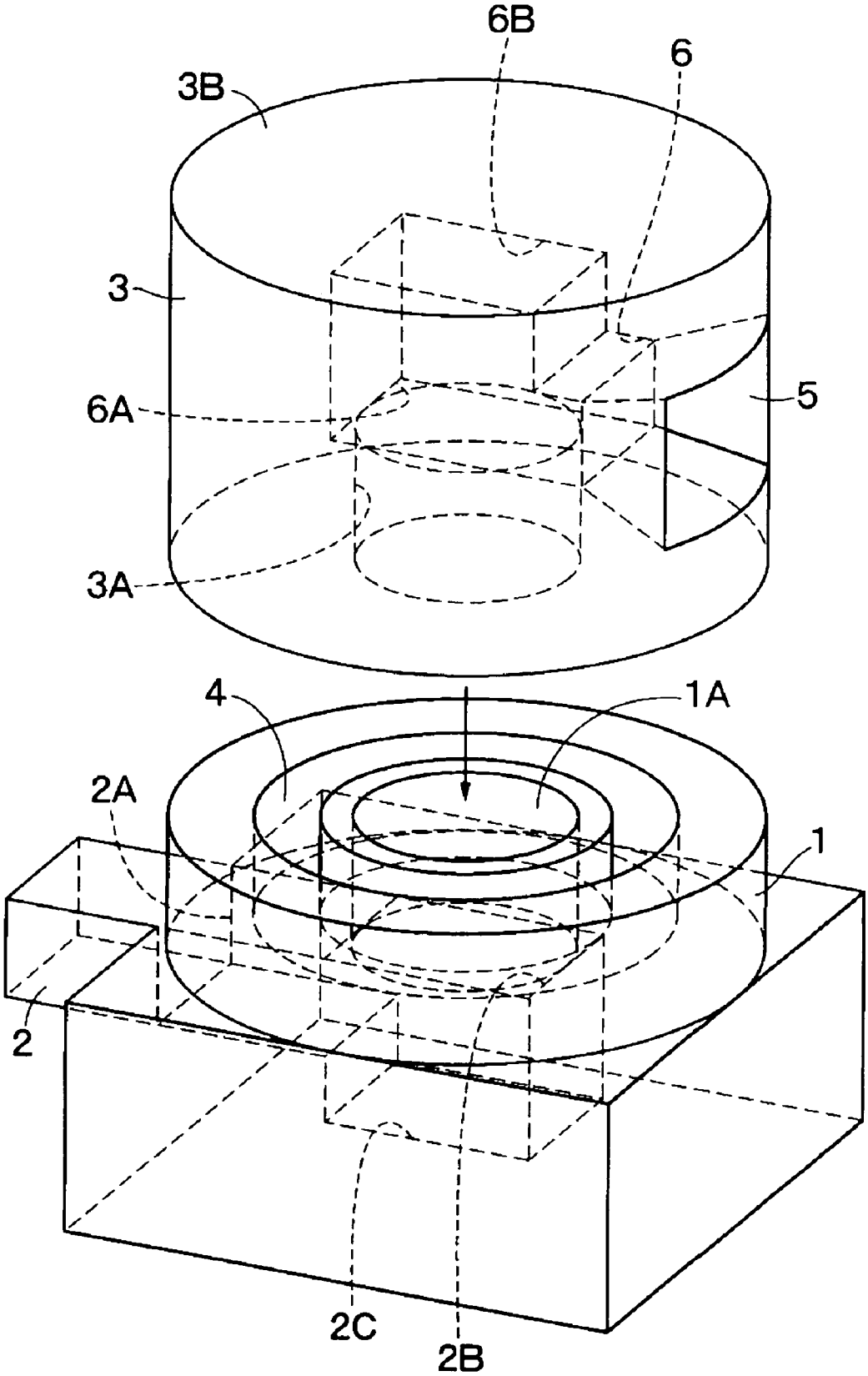
FIG. 2 is an exploded perspective view of the antenna apparatus according to the first preferred embodiment of the present invention.

An antenna apparatus and a transmitter/receiver according to a preferred embodiment of the present invention will be described below in detail with reference to the attached drawings.

First, FIGS. 1 to 8 show the antenna apparatus according to a first preferred embodiment and its various frequency characteristics.

In the drawings, reference numeral 1 denotes a fixed-side circular waveguide as a cylindrical fixed-side transmission line axially symmetrical about an axis O, and the fixed-side circular waveguide 1 is provided with a circular hole 1A perforated with a circular section and extending in an axial direction. The fixed-side circular waveguide 1 has a propagation mode in a TM01 mode as a magnetic field distribution that is axially symmetrical (rotationally symmetrical) about a transmission direction (axial direction) of high-frequency signals, for example.

The inner diameter ϕ of the circular hole 1A herein has a value that allows it to pass through the TM01 mode with a desired frequency in a sufficiently low loss state and blocks the next higher-order mode (TE21 mode). For example, in blocking or cut-off frequency characteristics versus the inner diameter ϕ shown in FIG. 6, when the inner diameter ϕ is less than about 3.5 mm, the TE21 mode with 83 GHz or less can be blocked while when the inner diameter ϕ is larger than about 3.3 mm, the TM01 mode with 68 GHz or more can be allowed to pass through. Hence, it is understood that when the desired frequency is in a 76 GHz band used for an on-vehicle millimeter wave radar, the inner diameter ϕ is preferably about 3.4 mm as an intermediate value between about 3.3 mm and about 3.5 mm, for example.

Reference numeral 2 denotes a rectangular waveguide connected to the fixed-side circular waveguide 1, and one end of the rectangular waveguide 2 is attached to one end (lower end in FIG. 1) of the fixed-side circular waveguide 1 while the other end of the rectangular waveguide 2 extending outside in a radial direction of a circle with center at an axis O. The rectangular waveguide 2 is provided with a substantially rectangular hole 2A extending in a longitudinal direction (radial direction), and the substantially rectangular hole 2A has a substantially rectangular section with a height L1 and a width L2. The rectangular waveguide 2 is also provided with a substantially rectangular connection hole 2B formed adjacent to the one end at a position opposing the circular hole 1A of the fixed-side circular waveguide 1 with a width L2 and a length L3, and the substantially rectangular hole 2A and the circular hole 1A are communicated with together through the connection hole 2B. Furthermore, around the connection hole 2B, a back short portion 2C is formed to include a concavity that is sunken lower than the bottom of the substantially rectangular hole 2A by a depth L4 as a space having a distance that is larger than other portions in the axial direction of the fixed-side circular waveguide 1.

The rectangular waveguide 2 also has a propagation mode in a TE10 mode with an electric field distribution that is substantially parallel with the axial direction of the fixed-side circular waveguide 1 and vertical and annular magnetic field distribution, for example. Then, the rectangular waveguide 2 is magnetically coupled with the fixed-side circular waveguide 1 through the connection hole 2B, so that the TE10 mode is converted into the TM01 mode. The portion between the two waveguides 1 and 2 performs as a mode conversion portion with the back short portion 2C.

Figure 7:
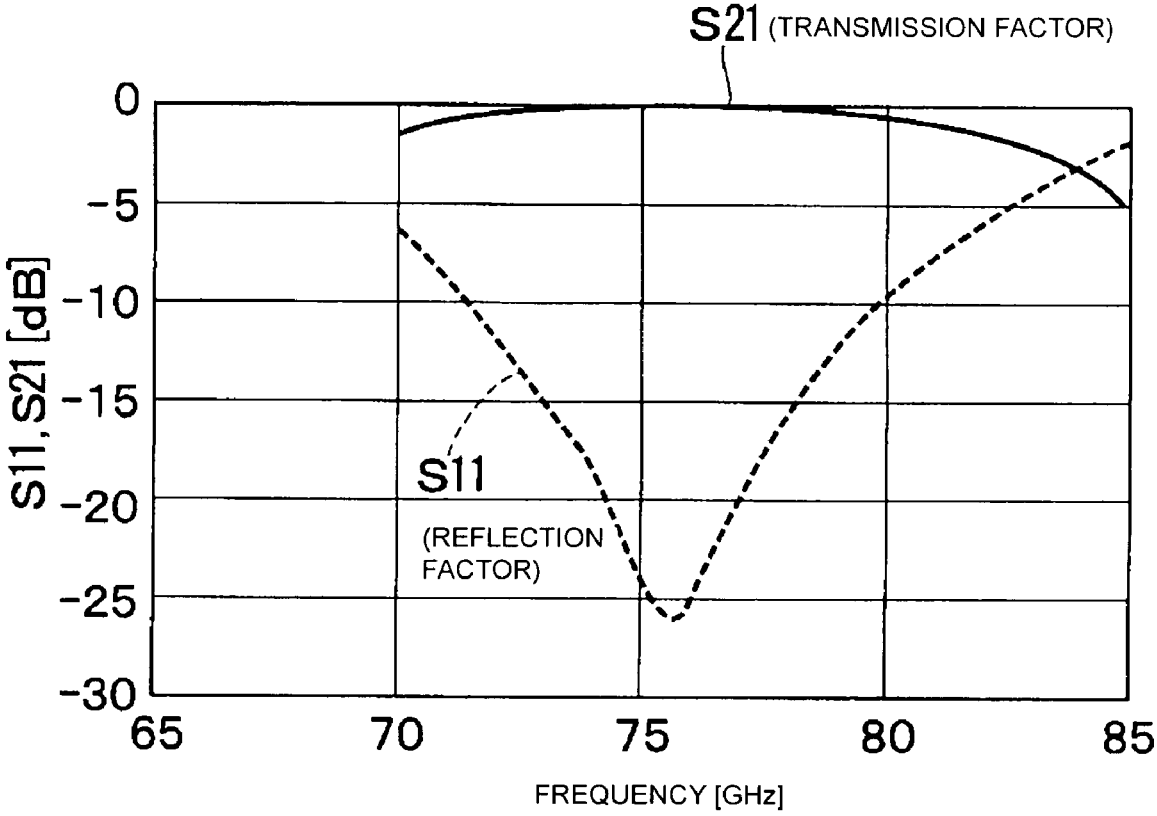
FIG. 7 is a characteristic diagram showing frequency characteristics of the reflection factor and the transmission factor between a rectangular waveguide and the fixed-side circular waveguide.

As an example, when the height L1 of the substantially rectangular hole 2A is about 1.27 mm; the width L2 is about 2.54 mm; the length L3 of the connection hole 2B and the back short portion 2C is about 3.4 mm; and the depth L4 of the back short portion 2C is about 1.0 mm, frequency characteristics of the reflection coefficient and the transmission coefficient between the rectangular waveguide 2 and the fixed-side circular waveguide 1 are shown in FIG. 7. As a result, it is understood that high-frequency signals at an approximately 76 GHz band can be transmitted in a low reflected state.

Reference numeral 3 denotes a rotation-side circular waveguide as an axially symmetrical and cylindrical rotation-side circular waveguide 1, which is provided with a substantially circular hole 3A having a circular cross-section with substantially the same inner diameter ϕ as that of the circular hole 1A of the fixed-side circular waveguide 1 and extending in an axial direction, and the substantially circular hole 3A extends to a halfway position in the axial direction. The rotation-side circular waveguide 3 is spaced from the fixed-side circular waveguide 1 by a space δ1 while being coaxially arranged along the axis O of the fixed-side circular waveguide 1 and is rotatable about the axis O along the entire circumference using a motor 7, which will be described later.

One end (lower end in FIG. 1) of the rotation-side circular waveguide 3 opposes the other end of the fixed-side circular waveguide 1 such that the substantially circular hole 3A opposes the circular hole 1A. On the other hand, the other end (upper end in FIG. 1) of the rotation-side circular waveguide 3 is closed with a substantially circular disc-like lid 3B while being attached in a state having a primary radiator 5 built therein, which will be described later.

The rotation-side circular waveguide 3 herein has a propagation mode in a TM01 mode with magnetic field distribution that is axially symmetrical (rotationally symmetrical) about the transmission direction (axial direction) of high-frequency signals, for example, as the same propagation mode as that of the fixed-side circular waveguide 1. Then, the rotation-side circular waveguide 3 is magnetically coupled with the fixed-side circular waveguide 1 so that the high-frequency signals in the TM01 mode are transmitted therethrough.

Reference numeral 4 denotes a waveguide-side choke provided in the fixed-side circular waveguide 1 at a position between the fixed-side circular waveguide 1 and the rotation-side circular waveguide 3 as a transmission line-side choke. The waveguide-side choke 4 includes a substantially ring-shaped circular groove. The waveguide-side choke 4 is also spaced from the outermost periphery of the circular hole 1A by a space L5.

Furthermore, the waveguide-side choke 4 having a width L6 and a depth L7 is concavely formed on an open end surface of the fixed-side circular waveguide 1 opposing the rotation-side circular waveguide 3. Thereby, the waveguide-side choke 4 virtually shorts portions (portion "a" in FIG. 3) in the vicinity of the outermost peripheries of the circular holes 1A and 3A of the circular waveguides 1 and 3.

Figure 8:
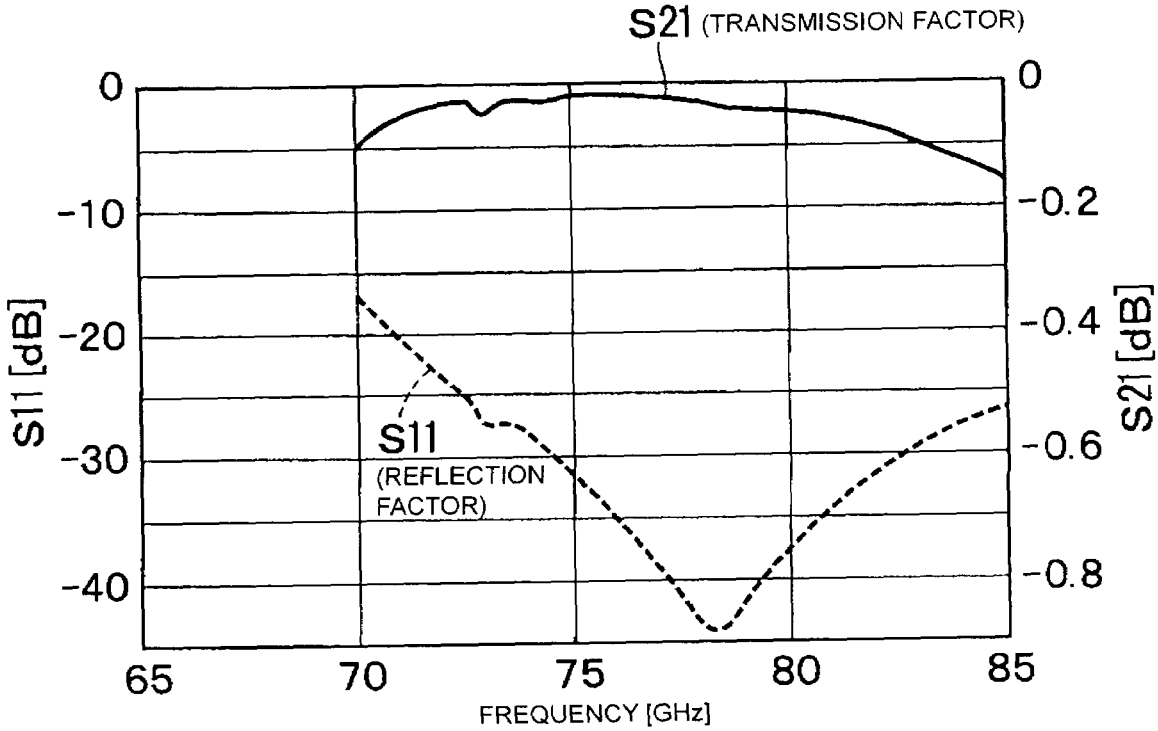
FIG. 8 is a characteristic diagram showing frequency characteristics of the reflection factor and the transmission factor between the fixed-side circular waveguide and the rotation-side circular waveguide.

As an example, when the space δ1 between the circular waveguides 1 and 3 is about 0.15 mm; the space L5 is about 0.5 mm; the width L6 of the waveguide-side choke 4 is about 1.0 mm; and the depth L7 thereof is about 1.5 mm, frequency characteristics of the reflection coefficient and the transmission coefficient between the circular waveguides 1 and 3 are shown in FIG. 8. As a result, it is understood that high-frequency signals at an approximately 76 GHz band can be transmitted in a low reflected state.

Reference numeral 5 denotes a primary radiator attached to the rotation-side circular waveguide 3 in a built-in state. The primary radiator 5 having a substantially rectangular section, for example, includes a waveguide horn antenna that is arranged to gradually expand radially to the outside. The end extremity of the primary radiator 5 herein is opened on the side surface of the rotation-side circular waveguide 3. Thereby, the primary radiator 5 can radiate a high-frequency signal beam in a direction that is substantially perpendicular to the axis O, for example, as a direction that is different from the rotational axis (axis O). On the other hand, the base end of the primary radiator 5 is connected to a rectangular waveguide portion 6 including a substantially rectangular hole radially extending with a substantially rectangular section.

The rectangular waveguide portion 6 is provided with a substantially rectangular connection hole 6A formed at a position opposing the substantially circular hole 3A of the rotation-side circular waveguide 3, and having a shape similar to the substantially rectangular hole 2A of the rectangular waveguide 2, for example, and extending to the other end (upper end in FIG. 1) of the substantially circular hole 3A of the rotation-side circular waveguide 3. The rectangular waveguide portion 6 is communicated with the substantially circular hole 3A through the connection hole 6A. Furthermore, around the connection hole 6A, there is provided a back short portion 6B with a space larger than other portions in the axial direction of 3 so as to have a shape similar to the back short portion 2C, for example.

The rectangular waveguide portion 6 has a propagation mode in a TM01 mode, for example, and is magnetically coupled with the rotation-side circular waveguide 3 through the connection hole 2B while a matched state is maintained between the rectangular waveguide portion 6 and the rotation-side circular waveguide 3 by the back short portion 6B.

Reference numeral 7 denotes a motor attached to the lid 3B of the rotation-side circular waveguide 3. The motor 7, together with the fixed-side circular waveguide 1 for example, is fixed to a casing (not shown), etc., so as to continuously rotate the rotation-side circular waveguide 3 about the axis O in all directions.

The waveguide according to the present preferred embodiment preferably has the unique configuration described above. The operation of the present preferred embodiment will now be described.

First, upon inputting high-frequency signals, such as millimeter waves, into the rectangular waveguide 2, the high-frequency signals are propagated through the rectangular waveguide 2 in the TE10 mode so as to reach the connection hole 2B. At this time, the rectangular waveguide 2 is coupled with the fixed-side circular waveguide 1 through the connection hole 2B, so that the high-frequency signals are converted into the TM01 mode from the TE10 mode, and are propagated through the fixed-side circular waveguide 1. Since the fixed-side circular waveguide 1 is arranged coaxially with the rotation-side circular waveguide 3, the high-frequency signals in the axially symmetrical TM01 mode are propagated through the rotation-side circular waveguide 3 regardless of the rotational displacement of the rotation-side circular waveguide 3. Also, since the rotation-side circular waveguide 3 is connected to the primary radiator 5 via the rectangular waveguide portion 6, the high-frequency signals are radiated outside from the primary radiator 5.

Still, according to the present preferred embodiment, the fixed-side circular waveguide 1 is arranged coaxially with the rotation-side circular waveguide 3, and both the waveguides have an axially symmetrical propagation mode in the TM01 mode, so that high-frequency signals can be propagated through the fixed-side circular waveguide 1 and the rotation-side circular waveguide 3 regardless of the rotational displacement of the rotation-side circular waveguide 3.

Between the fixed-side circular waveguide 1 and the rotation-side circular waveguide 3, the waveguide-side choke 4 is provided, so that both the waveguides are choke-coupled together and short-circuited at a high-frequency using the waveguide-side choke 4 so as to prevent the high-frequency signal from leaking from the gap between both the waveguides.

Furthermore, since the rotation-side circular waveguide 3 is provided with the primary radiator 5 that can radiate a high-frequency signal in a direction that is different from the rotational axis, the high-frequency signal can be radiated using the primary radiator 5 in a direction that is substantially perpendicular to the propagation direction of the rotation-side circular waveguide 3. Because the primary radiator 5 is constructed to rotate in conjunction with the rotation-side circular waveguide 3, while the whole circumference can be scanned with high-frequency signals about the rotational axis, the high-frequency signal can be radiated over an arbitrary angular range through the primary radiator by blocking an unnecessary radiation range, such as a semicircle, using a casing as long as the range is within 360° (whole circumference).

Also, when the antenna apparatus according to the present preferred embodiment is applied to a radar, while wide angle detection is possible over the whole circumference, angular resolution is greatly improved because of the detection at an arbitrary angle.

Furthermore, according to the present preferred embodiment, the rotation-side circular waveguide 3 is rotated in a predetermined direction (constant-speed rotation) using the motor 7, so that the constant-acceleration rotation, such as reciprocal movement, is not necessary unlike in a conventional technique so as to reduce the mechanical load to the driving system (the motor 7), thereby improving reliability and durability.

Also, the entire antenna apparatus has a simplified structure including the two circular waveguides 1 and 3 so as to be easily manufactured by cutting and injection molding, thereby reducing manufacturing cost.

Furthermore, since the circular waveguides 1 and 3 having a propagation mode in the TM01 mode are used, the fixed-side circular waveguide 1 or the rotation-side circular waveguide 3 can be easily connected to the rectangular waveguide 2 in the TE10 mode, for example, so as to easily feed high-frequency signals to the fixed-side circular waveguide 1 while the rotation-side circular waveguide 3 can be readily connected to the primary radiator 5 such as a horn antenna.

In addition, according to the first preferred embodiment, high-frequency signals are preferably propagated through the circular waveguides 1 and 3 in the TM01 mode. However, any high-frequency signals in a mode in which electric field distribution or magnetic field distribution is axially symmetrical, may be propagated, so that high-frequency signals in other modes, such as the TE01 mode and a coaxial TEM mode, may also be propagated.

Also, according to the first preferred embodiment, the waveguide-side choke is preferably constructed of the waveguide-side choke 4 including the ring-shaped groove surrounding the circular hole 1A. However, the present invention is not limited to this construction and the waveguide-side choke may also be constructed of any choke composed of a polygonal groove, such as a triangular or square groove, as long as the groove surrounds the circular hole.

According to the first preferred embodiment, the waveguide-side choke 4 is arranged on the opened end surface of the fixed-side circular waveguide 1. Alternatively, the waveguide-side choke may be arranged on the opened end surface of the rotation-side circular waveguide 3, or the waveguide-side chokes may also be provided on both the circular waveguides 1 and 3.

Figure 3:
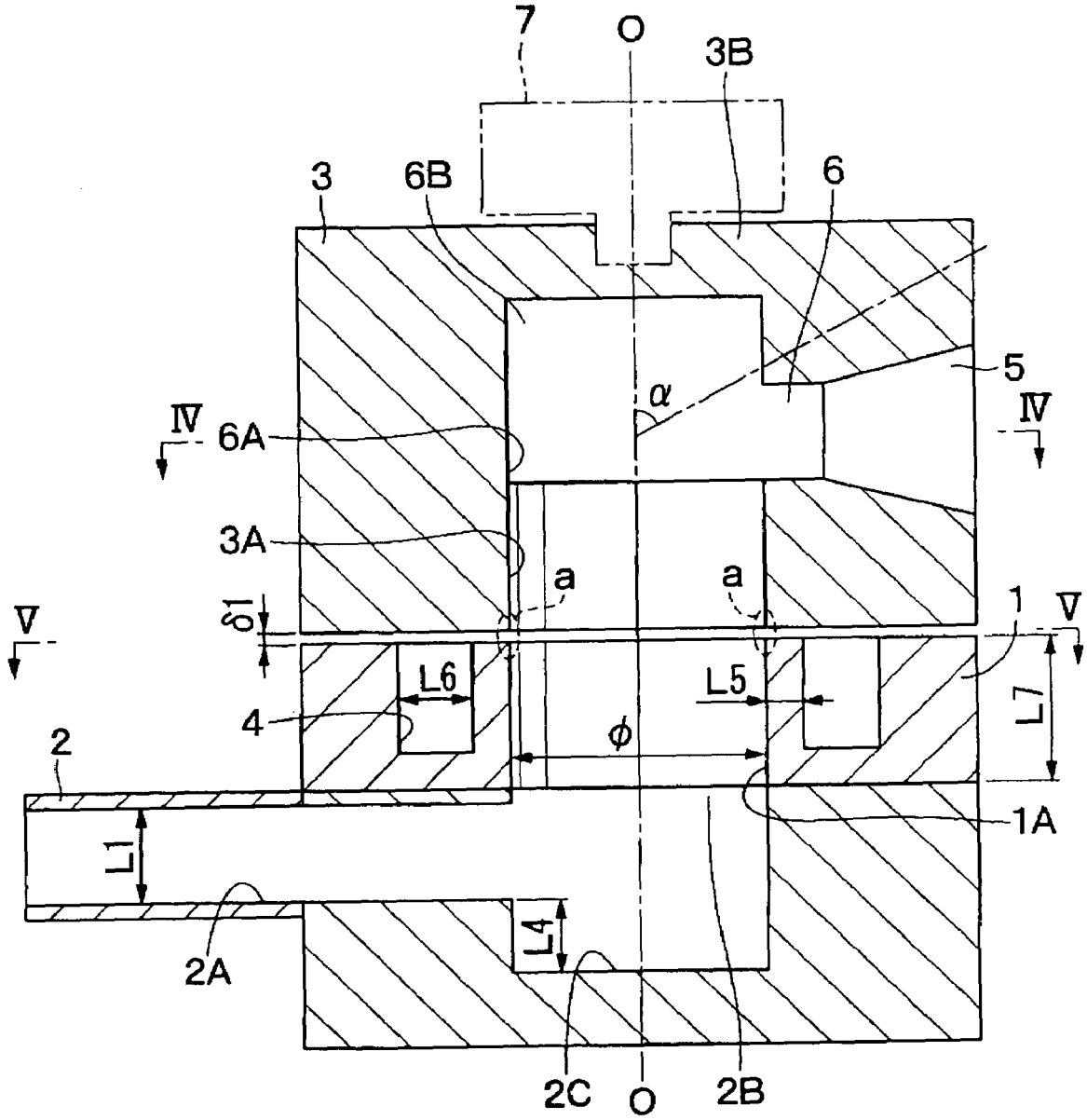
FIG. 3 is a longitudinal sectional view of the antenna apparatus viewed in arrow direction III—III of FIG. 1.
Figure 4:
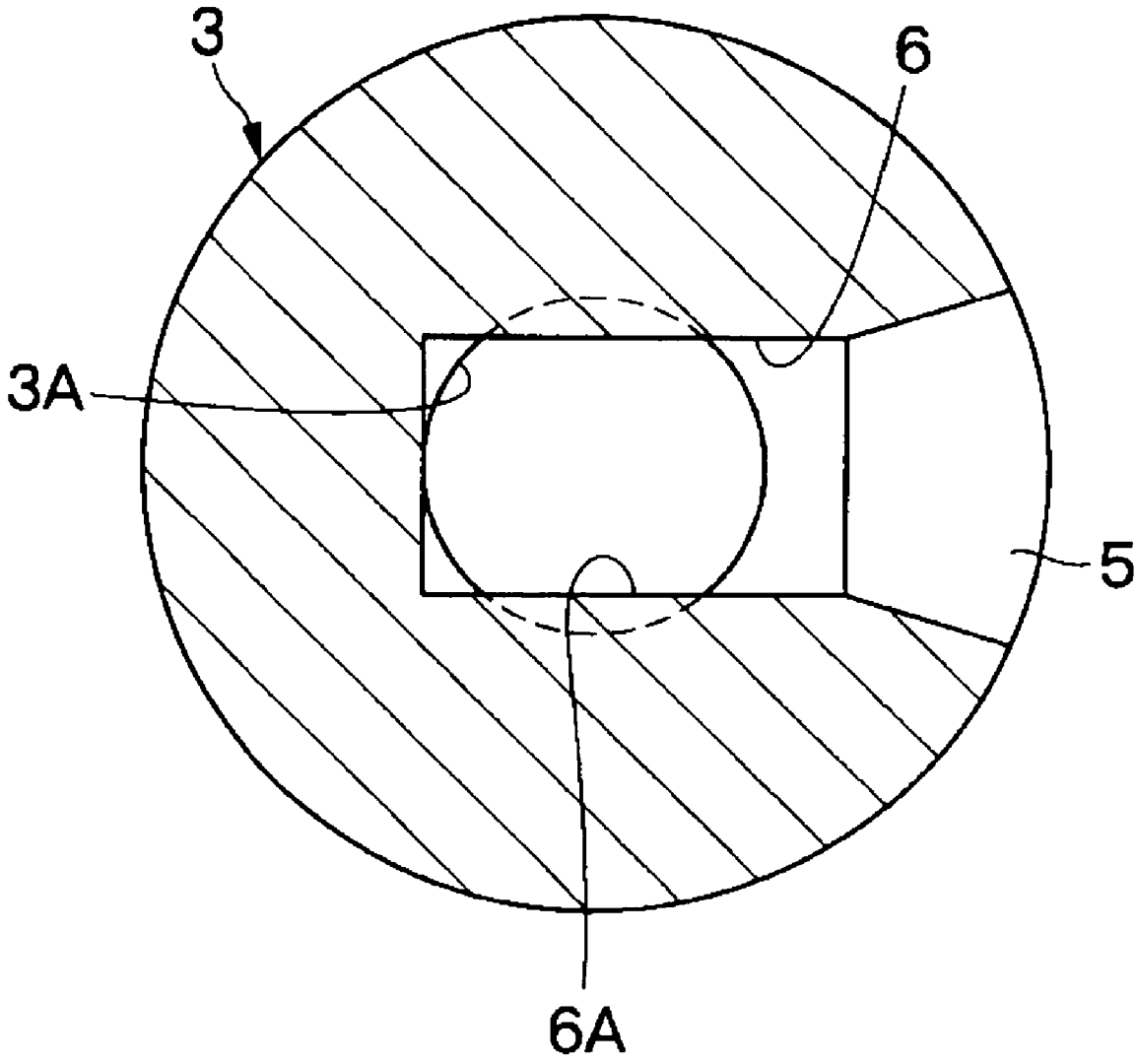
FIG. 4 is a cross-sectional view of a rotation-side circular waveguide viewed in arrow direction IV—IV of FIG. 3.
Figure 5:
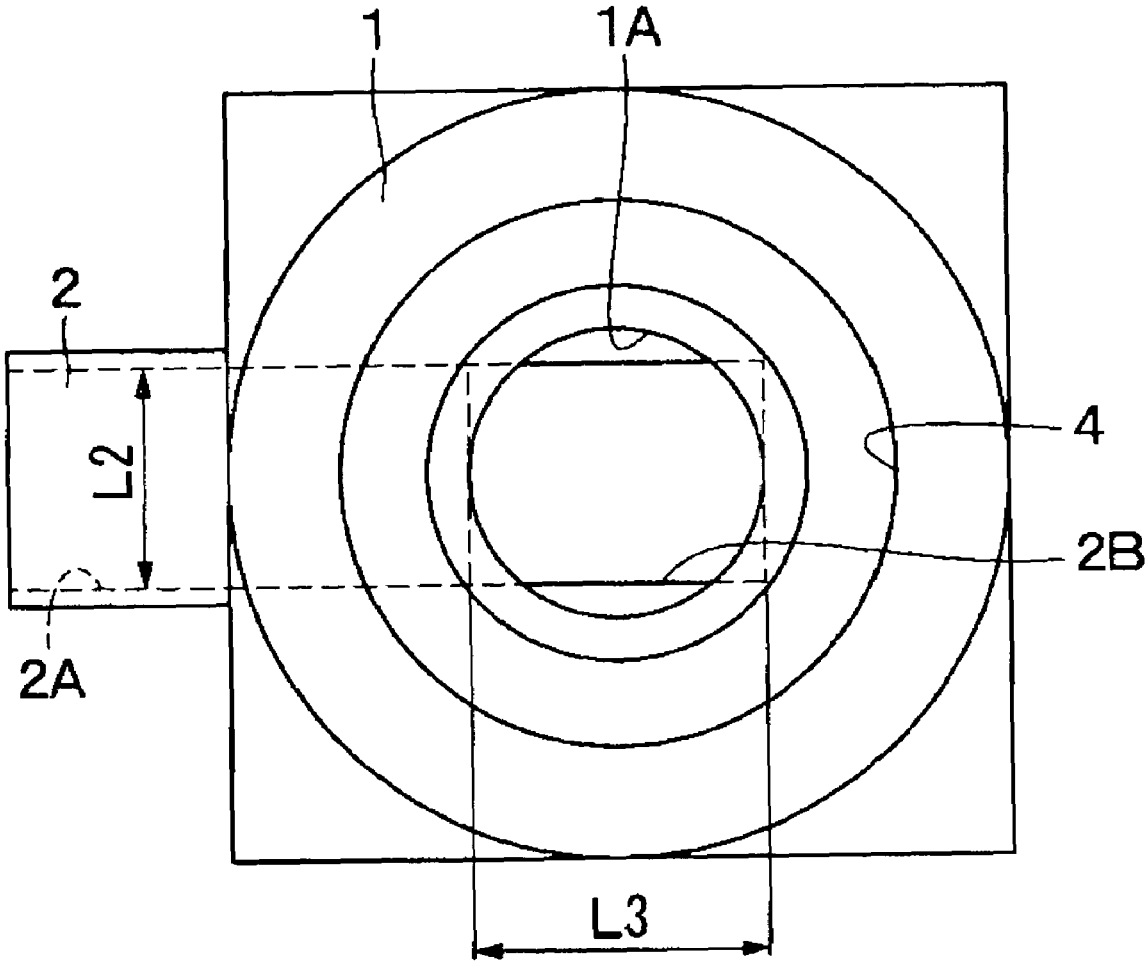
FIG. 5 is a plan view of a fixed-side circular waveguide viewed in arrow direction V—V of FIG. 3.
Figure 6:
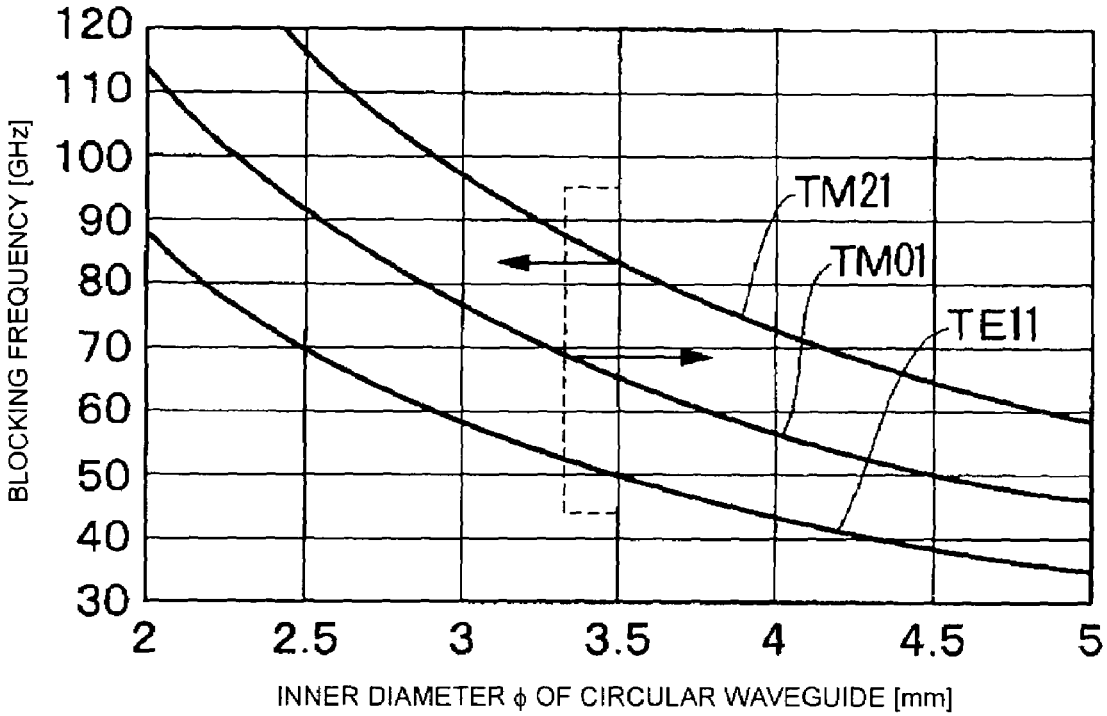
FIG. 6 is a characteristic diagram showing the relationship between the inner diameter and the blocking or cut-off frequency of a circular waveguide.

According to the first preferred embodiment, the primary radiator 5 preferably radiates a high-frequency signal beam in a direction that is substantially perpendicular to the rotational axis (the axis O) of the rotation-side circular waveguide 3. However, the present invention is not limited to this, so that if the high-frequency signal beam can be outside radiated radially from the rotational axis, the high-frequency signal beam may also be radiated in a direction inclined by an angle a relative to the rotational axis, as shown in FIG. 3, by attaching the primary radiator to be inclined.

According to the first preferred embodiment, the primary radiator 5 preferably includes the waveguide horn antenna with a substantially rectangular section. However, the present invention is not limited to this and the primary radiator may have other sections, such as a substantially circular or substantially elliptical section, so as to appropriately establish antenna characteristics, such as an antenna gain, a sidelobe level, and a beam width, responding to various demands. Moreover, the primary radiator is not limited to the waveguide horn antenna, so that other antenna devices, such as a microstrip antenna, may also be used.

Figure 9:
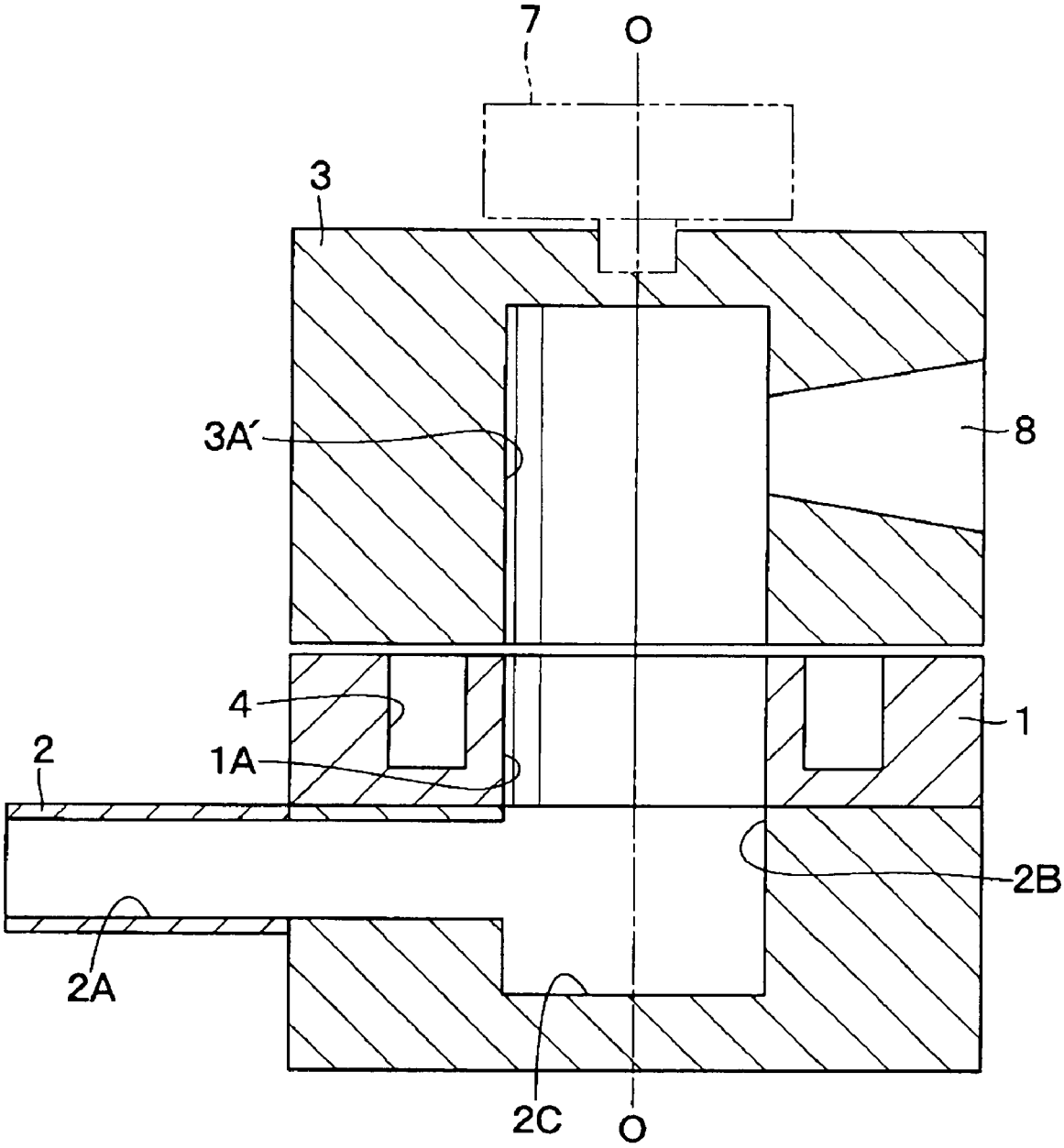
FIG. 9 is a longitudinal sectional view of an antenna apparatus according to a first modification viewed from the same position as that of FIG. 3.

Also, according to the first preferred embodiment, the rotation-side circular waveguide 3 and the primary radiator 5 are preferably connected together via the rectangular waveguide portion 6. However, the present invention is not limited to this, so that a primary radiator 8 may also be directly connected to a portion of a circular hole 3A' like in a first modification shown in FIG. 9.

Moreover, according to the first preferred embodiment, the primary radiator 5 is preferably attached to the rotation-side circular waveguide 3 in a built-in state. Alternatively, the primary radiator 5 may be attached to the side surface of the rotation-side circular waveguide 3 to protrude therefrom by extending the rectangular waveguide portion 6 to the side surface (external periphery) of the rotation-side circular waveguide 3.

Figure 10:
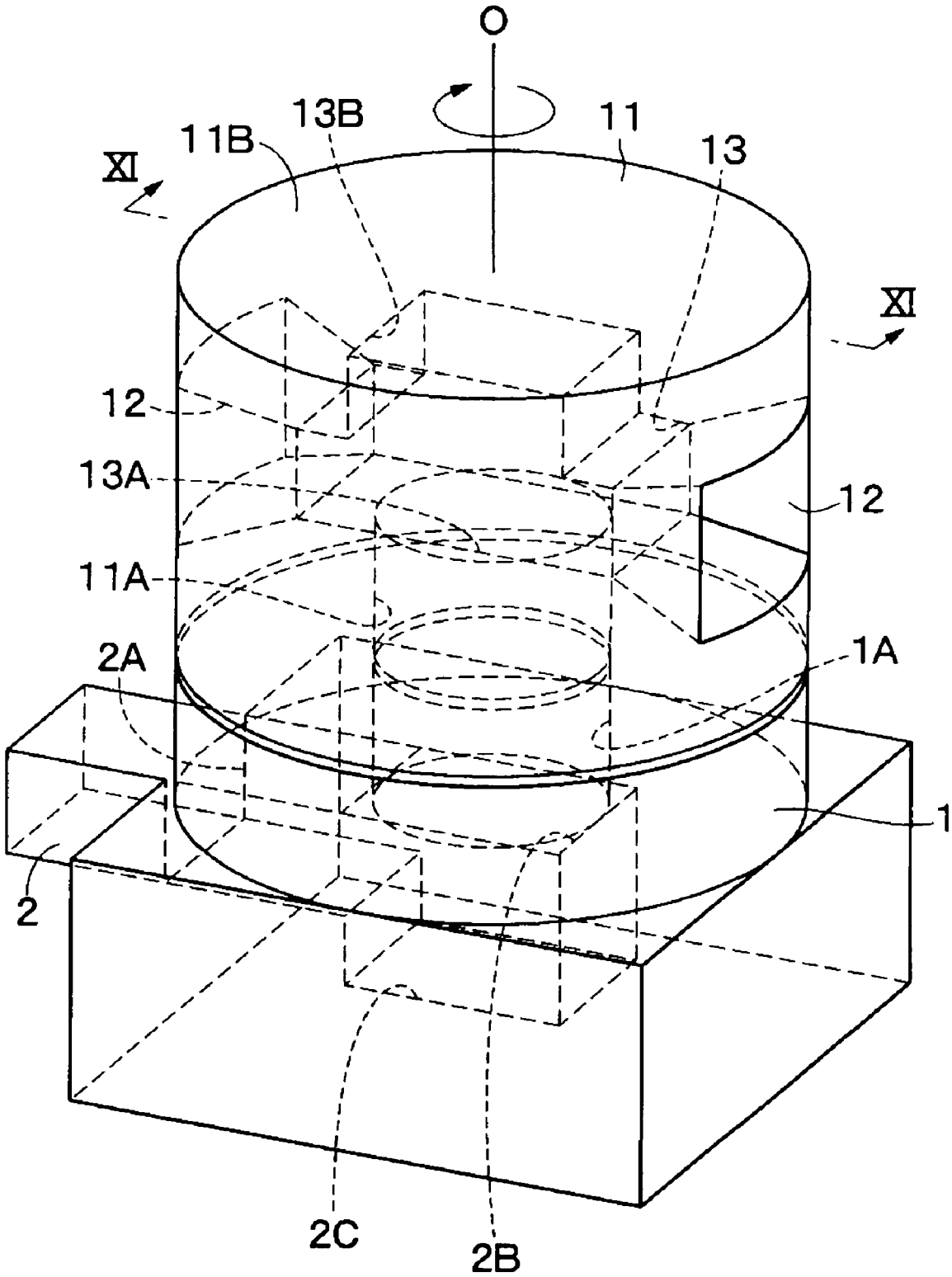
FIG. 10 is a perspective view of an antenna apparatus according to a second preferred embodiment of the present invention shown in a state in that a casing is removed.
Figure 11:
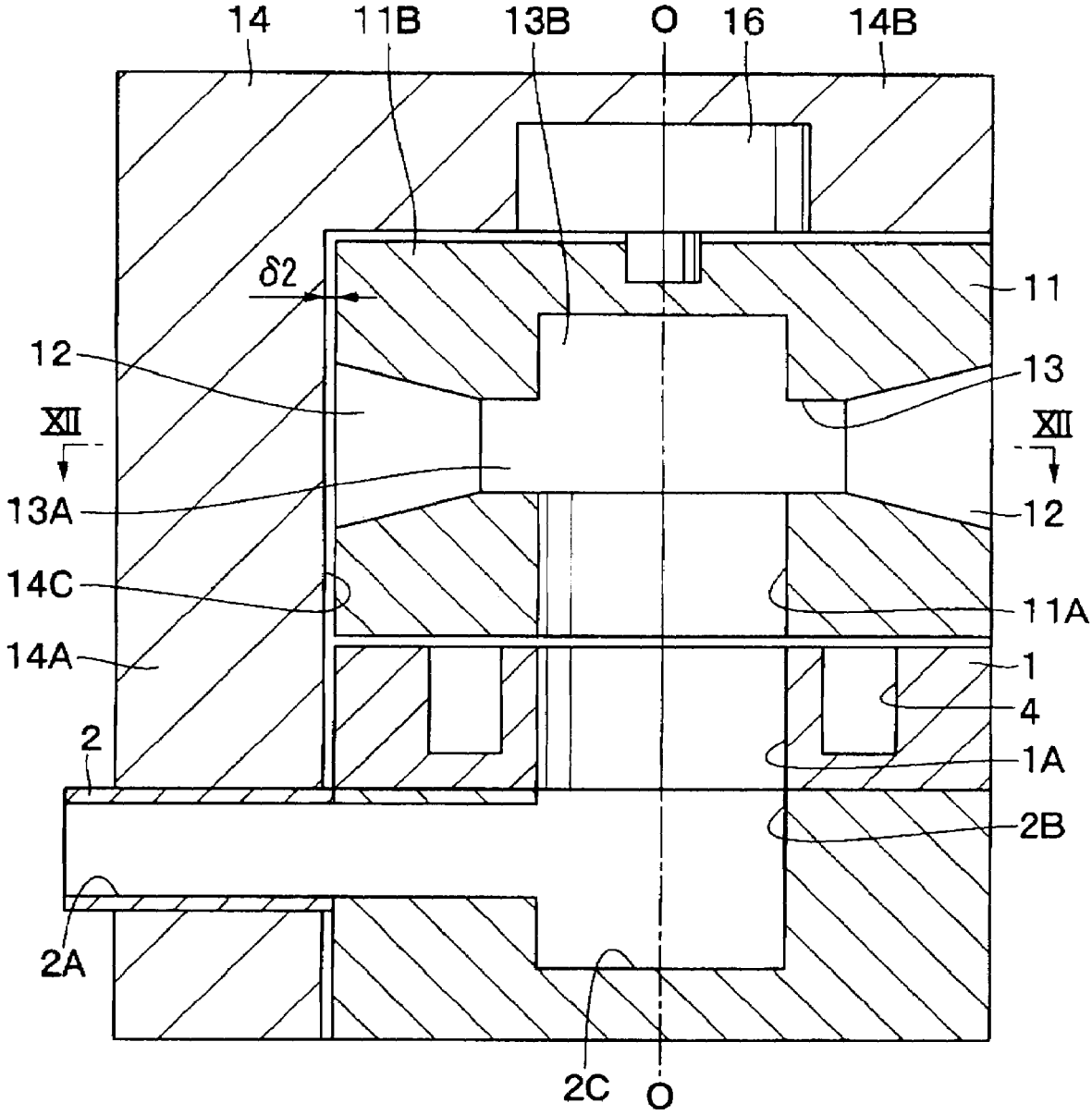
FIG. 11 is a longitudinal sectional view of the antenna apparatus viewed in arrow direction XI—XI of FIG. 10.
Figure 12:
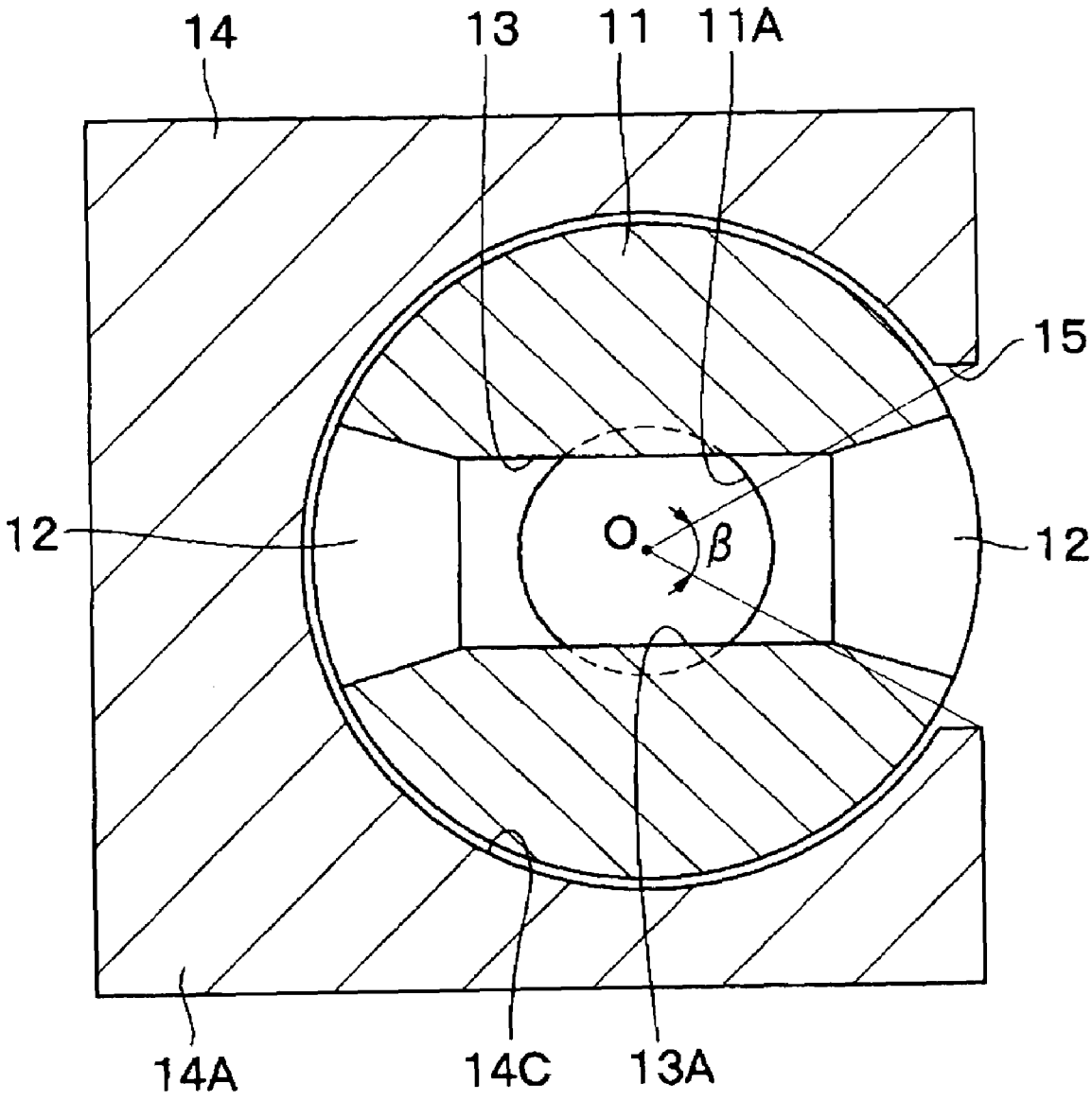
FIG. 12 is a cross-sectional view of a rotation-side circular waveguide and the casing viewed in arrow direction XII—XII of FIG. 11.
Figure 13:
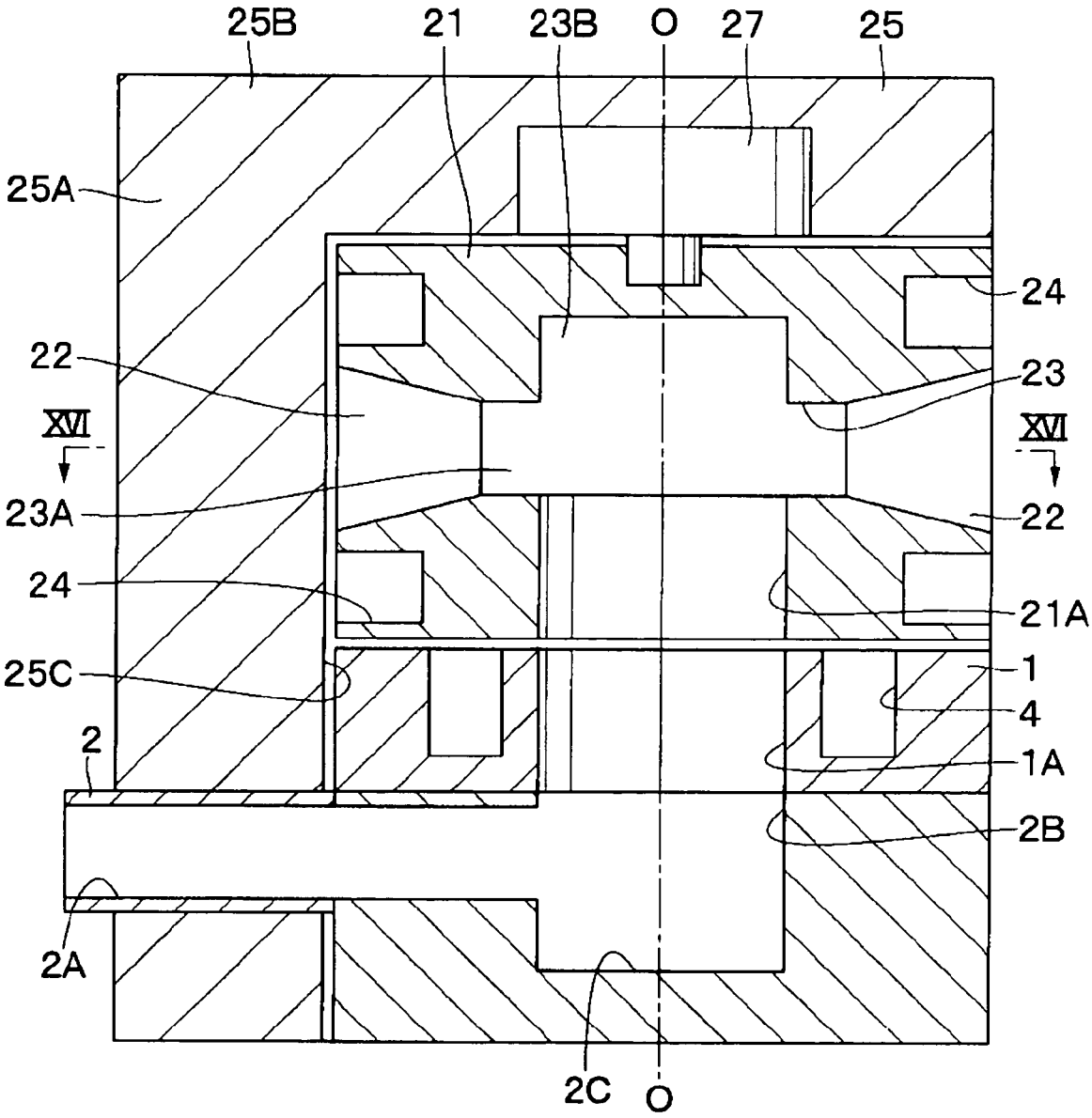
FIG. 13 is a longitudinal sectional view of an antenna apparatus according to a third preferred embodiment of the present invention viewed from the same position as that of FIG. 3.
Figure 14:
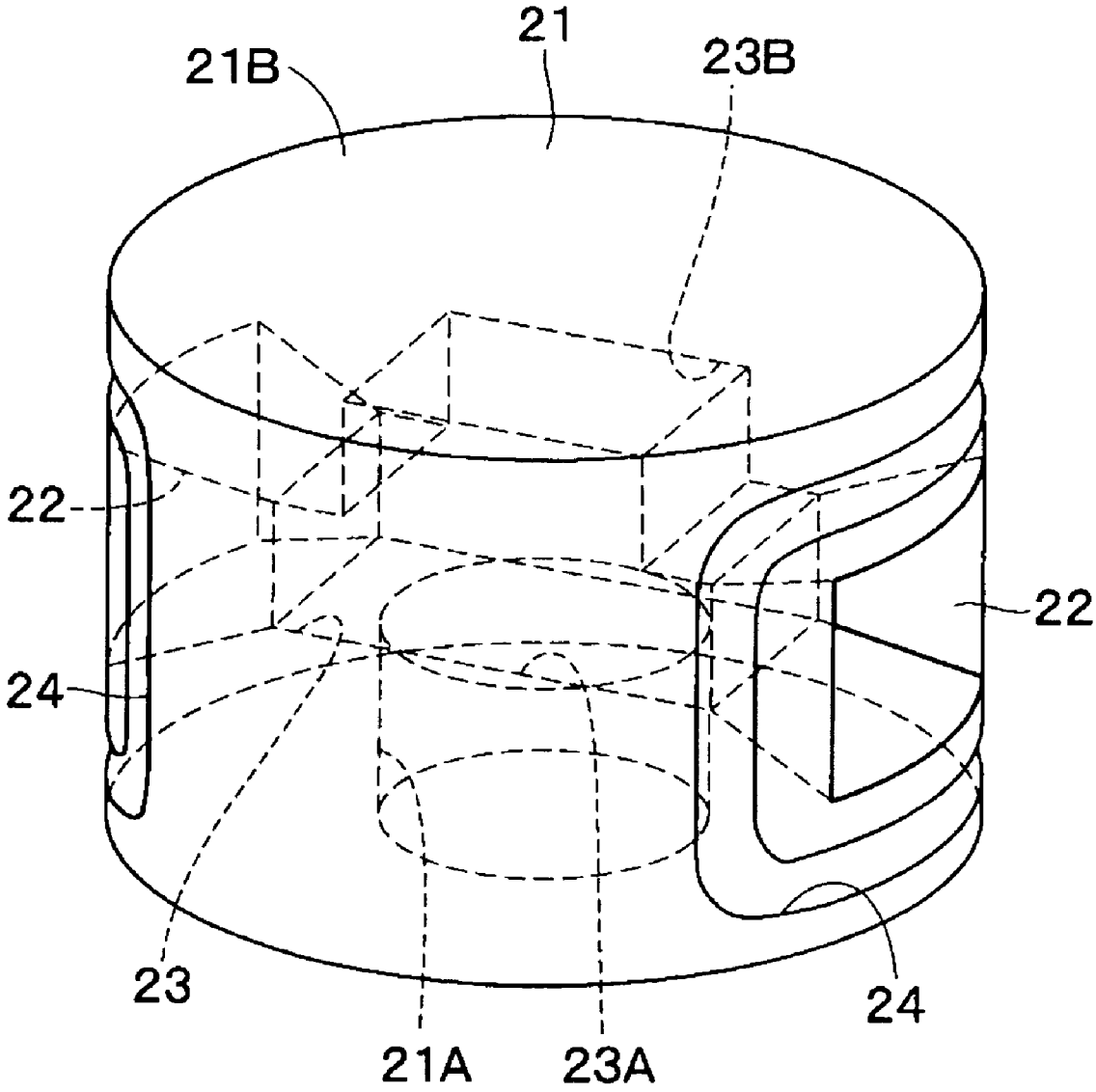
FIG. 14 is a perspective view of a rotation-side circular waveguide according to the third preferred embodiment of the present invention shown in a single unit.
Figure 15:
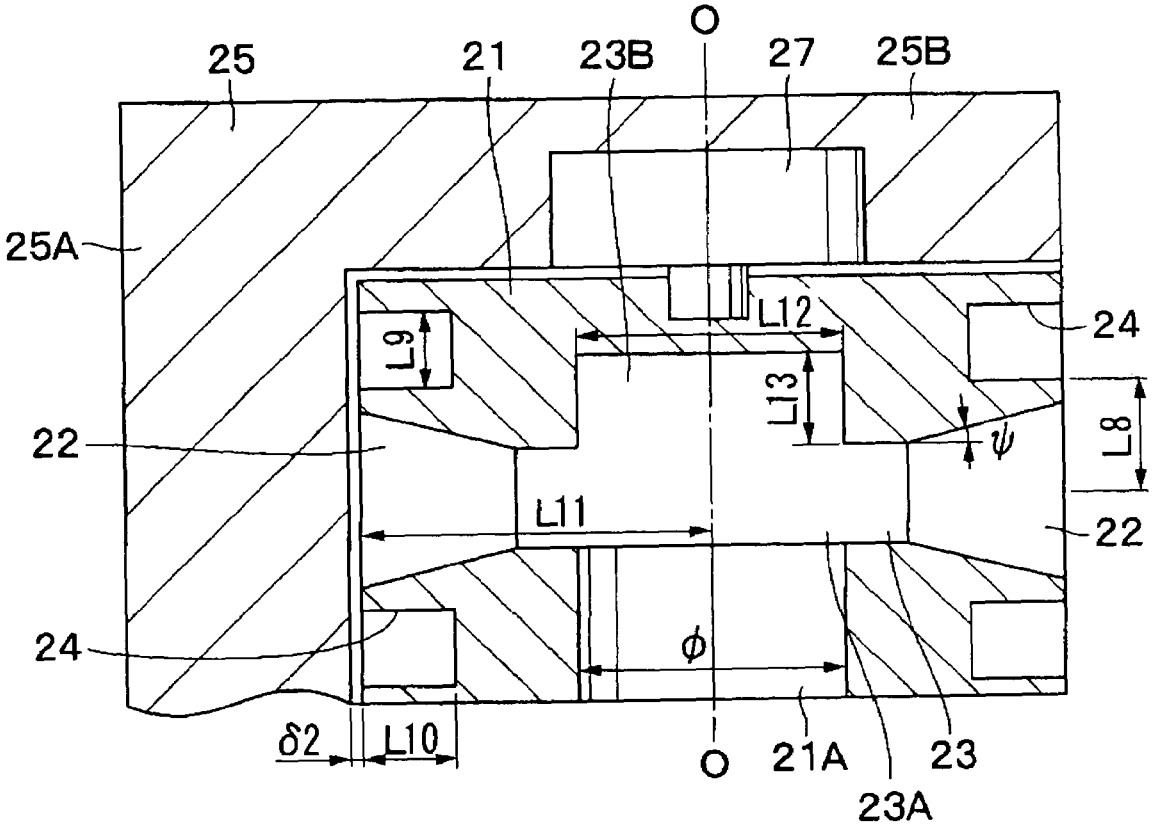
FIG. 15 is a longitudinal sectional view of an essential portion of the rotation-side circular waveguide in FIG. 13.

Next, FIGS. 10 to 12 show an antenna apparatus according to a second preferred embodiment of the present invention. One of the unique features of the present preferred embodiment is that a rotation-side circular waveguide is provided with two primary radiators attached thereto. In addition, according to the present preferred embodiment, like reference characters designate like components common to the first preferred embodiment and the description thereof is omitted.

Reference numeral 11 denotes a rotation-side circular waveguide according to the second preferred embodiment. The rotation-side circular waveguide 11 preferably has an axially symmetrical and cylindrical shape similar to the rotation-side circular waveguide 3 according to the first preferred embodiment. Also, the rotation-side circular waveguide 11 is provided with a substantially circular hole 11A perforated with a substantially circular section with substantially the same inner diameter as the circular hole 1A of the fixed-side circular waveguide 1 and extending in an axial direction. The substantially circular hole 11A extends to a halfway position in the axial direction, so that high-frequency signals can be propagated in the TM01 mode.

The rotation-side circular waveguide 11 is spaced from the fixed-side circular waveguide 1 by a space of about 0.15 mm while being arranged coaxially with the axis O of the fixed-side circular waveguide 1 and is rotatable over the whole circumference about the axis O by a motor 16, which will be described later.

One end (lower end in FIG. 10) of the rotation-side circular waveguide 11 opposes the other end of the fixed-side circular waveguide 1, and the other end (upper end in FIG. 10) of the rotation-side circular waveguide 11 is closed with a disc-like lid 11B. The rotation-side circular waveguide 11 is magnetically coupled with the fixed-side circular waveguide 1 and high-frequency signals are propagated between the waveguides in the TM01 mode.

Reference numeral 12 denotes two primary radiators attached to the rotation-side circular waveguide 11 in a built-in state. Each primary radiator 12 preferably includes a waveguide horn antenna in a manner similar to the primary radiator 5 according to the first preferred embodiment. The two primary radiators 12 are radially arranged in directions that are different from each other from the rotational axis (the axis O) as a center, opposite to each other, for example. The end extremity of the primary radiator 12 is opened on the side surface of the rotation-side circular waveguide 11. On the other hand, the base end of the primary radiator 12 radially extends to be connected to a rectangular waveguide portion 13 with a propagation mode in the TE10 mode.

The rectangular waveguide portion 13 is provided with a substantially rectangular connection hole 13A formed at a position opposing the substantially circular hole 11A of the rotation-side circular waveguide 11 and extending to the other end (upper end in FIG. 10) of the substantially circular hole 11A of the rotation-side circular waveguide 11. Furthermore, around the connection hole 13A, a back short portion 13B is formed to have a space distance larger than other portions in the axial direction of the rotation-side circular waveguide 11.

Reference numeral 14 denotes a casing arranged to surround the circular waveguides 1 and 11, and the casing 14 includes a cylinder portion 14A fixed to the fixed-side circular waveguide 1 and the rectangular waveguide 2 so as to cover the external periphery of the rotation-side circular waveguide 11, and a top board portion 14B arranged at the upper end of the cylinder portion 14A so as to cover the lid 11B of the rotation-side circular waveguide 11. The cylinder portion 14A is provided with an accommodation hole 14C formed inside so as to accommodate the rotation-side circular waveguide 11 therein to have a gap δ2 of about 0.15 mm relative to the external surface of the rotation-side circular waveguide 11.

Reference numeral 15 denotes a radiator opening formed in the cylinder portion 14A, and the radiator opening 15, as shown in FIG. 12, is penetrated at a position (opposable position) corresponding to the primary radiator 12. The radiator opening 15 has an area that is greater than that of the opening of the primary radiator 12, and is opened over an angular range β about the rotational axis (the axis O) of the rotation-side circular waveguide 11. The radiator opening 15 is connected to the two primary radiators 12 rotating together with the rotation-side circular waveguide 11 sequentially from any one of the two radiators.

Reference numeral 16 denotes a motor fixed to the top board portion 14B of the casing 14. The rotational axis of the motor 16 is attached to the lid 11B of the rotation-side circular waveguide 11 so as to continuously rotate the rotation-side circular waveguide 11 about the axis O in all directions by the motor 16.

In such a manner, according to the present preferred embodiment, the same effects and advantages as those achieved by the first preferred embodiment can also be obtained. Moreover, according to the present preferred embodiment, while the two primary radiators 12 arranged in directions opposite to each other are provided in the rotation-side circular waveguide 11, the respective primary radiators 12 are sequentially connected to the radiator opening 15 of the casing 14 along with the rotation of the rotation-side circular waveguide 11, so that while one of the primary radiators 12 is radiating high-frequency signals, the other is surrounded by the casing 14 so that the radiation of the high-frequency signals can be blocked. Thereby, while the rotation-side circular waveguide 11 is making one revolution, the two primary radiators 12 are connected to the radiator opening 15 so as to radiate the high-frequency signals, so that in comparison with the single primary radiator attached thereto, a period of time radiating the high-frequency signals in a predetermined direction through the radiator opening 15 within one revolution can be increased so as to increase the detection period and communication period.

In particular, when the angle β of the radiator opening 15 is 180°, any one of the two primary radiators 12 arranged in directions opposite to each other across the rotational axis as the center is always connected to the radiator opening 15, so that detection or communication can be always carried out.

According to the present preferred embodiment, the two primary radiators 12 are preferably attached to the rotation-side circular waveguide 11. Alternatively, three or more primary radiators may be attached. While a plurality of primary radiators are arranged at equal intervals (120° intervals when three radiators are provided, for example) in the circumferential direction about the rotational axis of the rotation-side circular waveguide as the center, in accordance with the intervals, the angular range (120° intervals when three radiators are provided, for example) of the radiator opening of the casing may be established. Also, a plurality of primary radiators may be arranged at different intervals in the circumferential direction about the rotational axis of the rotation-side circular waveguide as the center.

Furthermore, according to the present preferred embodiment, the two primary radiators 12 are preferably radially arranged about the rotational axis of the rotation-side circular waveguide 11 as the center. However, they may be arranged in different directions from each other, and they may be spirally arranged, for example.

Next, FIGS. 13 to 17 show an antenna apparatus and frequency characteristics regarding the antenna apparatus according to a third preferred embodiment of the present invention. One of the unique features of the third preferred embodiment is that while a rotation-side circular waveguide is provided with two primary radiators attached thereto, a radiator-side choke is provided around an open end of each primary radiator. In addition, according to the present preferred embodiment, like reference characters designate like components common to the first preferred embodiment and the description thereof is omitted.

Reference numeral 21 denotes a rotation-side circular waveguide according to the third preferred embodiment. The rotation-side circular waveguide 21 preferably has an axially symmetrical and cylindrical shape similar to the rotation-side circular waveguide 3 according to the first preferred embodiment. Also, the rotation-side circular waveguide 21 is provided with a substantially circular hole 21A perforated with a substantially circular section with substantially the same inner diameter as the circular hole 1A of the fixed-side circular waveguide 1 and extending in an axial direction. The substantially circular hole 21A extends to a halfway position in the axial direction.

The rotation-side circular waveguide 21 is spaced from the fixed-side circular waveguide 1 by a space of about 0.15 mm while being arranged coaxially with the axis O of the fixed-side circular waveguide 1 and is rotatable about the axis O. One end of the rotation-side circular waveguide 21 has the substantially circular hole 21A opened therefrom, and the other end of the rotation-side circular waveguide 21 is closed with a disc-like lid 21B. Furthermore, the rotation-side circular waveguide 21 is surrounded with a casing 25, which will be described later, and spaced from the casing 25 by a space δ2. The rotation-side circular waveguide 21 is magnetically coupled with the fixed-side circular waveguide 1 and high-frequency signals are propagated between the waveguides in the TM01 mode.

Reference numeral 22 denotes two primary radiators attached to the rotation-side circular waveguide 21 in a built-in state. Each primary radiator 22 preferably includes a waveguide horn antenna gradually expanding at an expanding angle ϕ in a manner similar to the primary radiator 5 according to the first preferred embodiment. The two primary radiators 22 are radially arranged in directions that are different from each other from the rotational axis (the axis O) as a center at equal intervals in the circumferential direction (directions opposite to each other). The end extremity of each primary radiator 22 is opened on the side surface of the rotation-side circular waveguide 21. On the other hand, the base end of the primary radiator 22 radially extends to be connected to a rectangular waveguide portion 23 with a propagation mode in the TE10 mode.

The rectangular waveguide portion 23 is provided with a substantially rectangular connection hole 23A formed at a position opposing the substantially circular hole 21A of the rotation-side circular waveguide 21 so as to have substantially the same size as that of the substantially rectangular hole 2A of the rectangular waveguide 2 according to the first preferred embodiment and to extend to the other end of the substantially circular hole 21A of the rotation-side circular waveguide 21. Furthermore, around the connection hole 23A, a back short portion 23B is formed for matching the rotation-side circular waveguide 21 (the substantially circular hole 21A) with the rectangular waveguide portion 23.

Reference numeral 24 denotes a radiator-side choke provided in the rotation-side circular waveguide 21 to surround the open end of the primary radiator 22, and two radiator-side chokes 24 are provided on the external surface of the rotation-side circular waveguide 21 corresponding to the two respective primary radiators 22, and include substantially elliptical (substantially rectangular) grooves. Also, the radiator-side choke 24 is arranged at a position spaced from the center of the open end of the primary radiator 22 by a space L8.

Furthermore, the radiator-side choke 24 has a width L9 and a depth L10, and is concavely arranged on the external surface of the rotation-side circular waveguide 21. Thereby, the radiator-side choke 24 virtually shorts between the vicinity of the open end of the primary radiator 22 and the casing 25 which will be described later.

Figure 17:
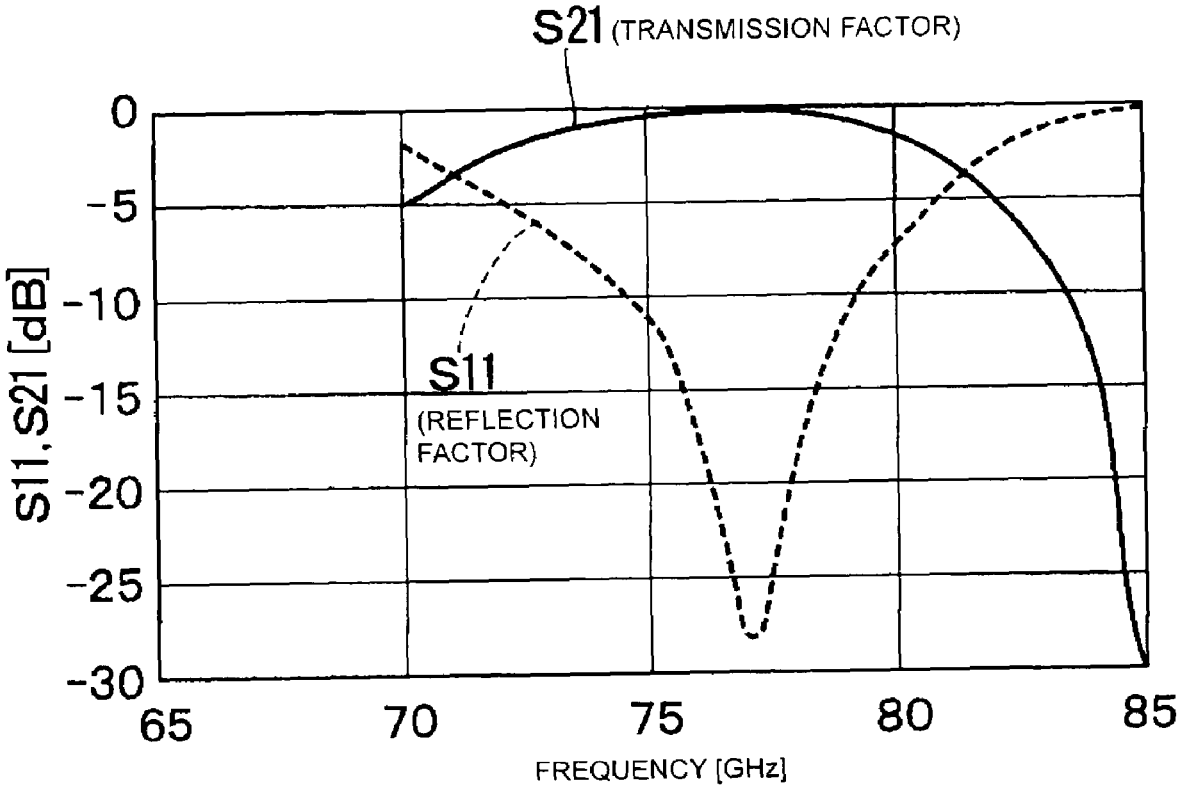
FIG. 17 is a characteristic diagram showing frequency characteristics of the reflection factor and the transmission factor between a primary radiator and the rotation-side circular waveguide.

As an example, when one primary radiator 22 is opposed (blocked) to the casing 25 and the other is opened (capable of radiating), frequency characteristics of the reflection factor and the transmission factor between the other primary radiator 22 and the rotation-side circular waveguide 21 are shown in FIG. 17. Where the expanding angle ϕ of the primary radiator 22 is 0°; the space δ2 between the rotation-side circular waveguide 21 and the casing 25 is about 0.15 mm; the space L8 is about 1.7 mm; the width L9 of the radiator-side choke 24 is about 1.0 mm; the depth L10 is about 1.2 mm; the distance L11 from the rotational axis to the open end of the primary radiator 22 is about 4.5 mm; the length L12 of the back short portion 23B is about 3.4 mm; and the height L13 of the back short portion 23B is about 0.8 mm. As a result, it is understood that high-frequency signals at an approximately 76 GHz band can be transmitted in a low reflection state.

Reference numeral 25 denotes a casing arranged to surround the circular waveguides 1 and 21, and the casing 25 preferably includes a cylinder portion 25A fixed to the fixed-side circular waveguide 1 and the rectangular waveguide 2 so as to cover the external periphery of the rotation-side circular waveguide 21, and a top board portion 25B arranged at the upper end of the cylinder portion 25A so as to cover the lid 21B of the rotation-side circular waveguide 21. The cylinder portion 25A is provided with an accommodation hole 25C formed inside so as to accommodate the rotation-side circular waveguide 21 therein.

Figure 16:
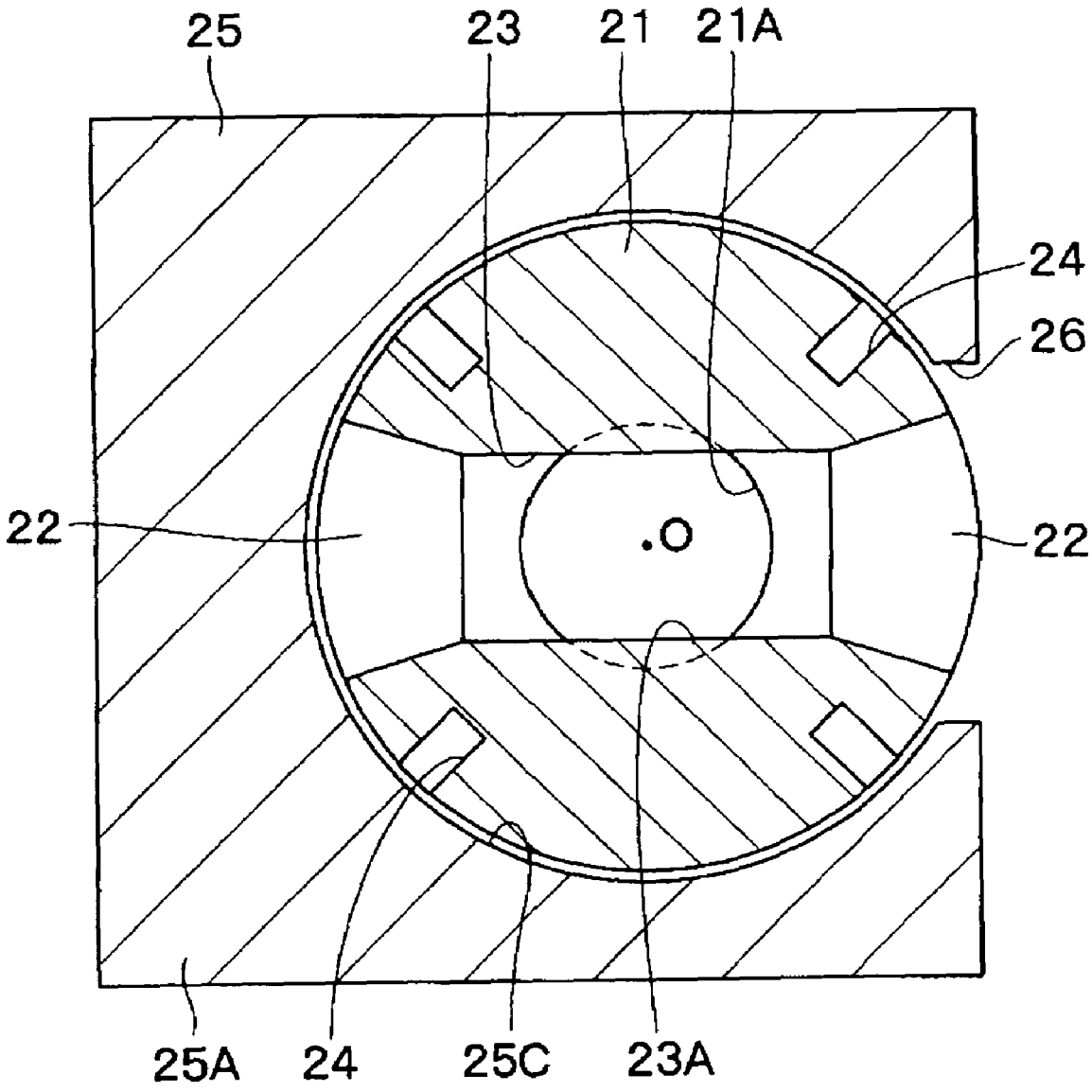
FIG. 16 is a cross-sectional view of the rotation-side circular waveguide and the casing viewed in arrow direction XVI—XVI of FIG. 13.

Reference numeral 26 denotes a radiator opening formed in the cylinder portion 25A, and the radiator opening 26, as shown in FIG. 16, is penetrated at a position (opposable position) corresponding to the primary radiator 22. The radiator opening 26 has an area greater than that of the opening of the primary radiator 22, and is opened over a predetermined angular range about the rotational axis (the axis O) of the rotation-side circular waveguide 21. The radiator opening 26 is connected to the two primary radiators 22 rotating together with the rotation-side circular waveguide 21 sequentially from any one of the two radiators.

Reference numeral 27 denotes a motor fixed to the top board portion 25B of the casing 25. The rotational axis of the motor 27 is attached to the lid 21B of the rotation-side circular waveguide 21 so as to continuously rotate the rotation-side circular waveguide 21 about the axis O in all directions by the motor 27.

In such a manner, according to the present preferred embodiment, the same effects and advantages as those achieved by the first and the second preferred embodiments can also be obtained. Moreover, according to the present preferred embodiment, while the two primary radiators 22 arranged in directions opposite to each other are preferably provided in the rotation-side circular waveguide 21, the respective primary radiators 22 are sequentially connected to the radiator opening 26 of the casing 25 along with the rotation of the rotation-side circular waveguide 21, so that while one of the primary radiators 22 is radiating high-frequency signals, the other is surrounded by the casing 25 so that the radiation of the high-frequency signals can be blocked.

Since the radiator-side choke 24 is provided on the external surface of the rotation-side circular waveguide 21 so as to surround the open end of the primary radiator 22 especially according to the present preferred embodiment, the open end of one of the two primary radiators 22, which is surrounded with the casing 25, and the casing 25 can be shorted at a high-frequency using the radiator-side choke 24. As a result, while one of the primary radiators 22 is radiating high-frequency signals through the radiator opening 26, the high-frequency signals can be prevented from leaking through between the residual primary radiator 22 and the casing 25, so that the loss of the entire antenna apparatus can be prevented.

Figure 18:
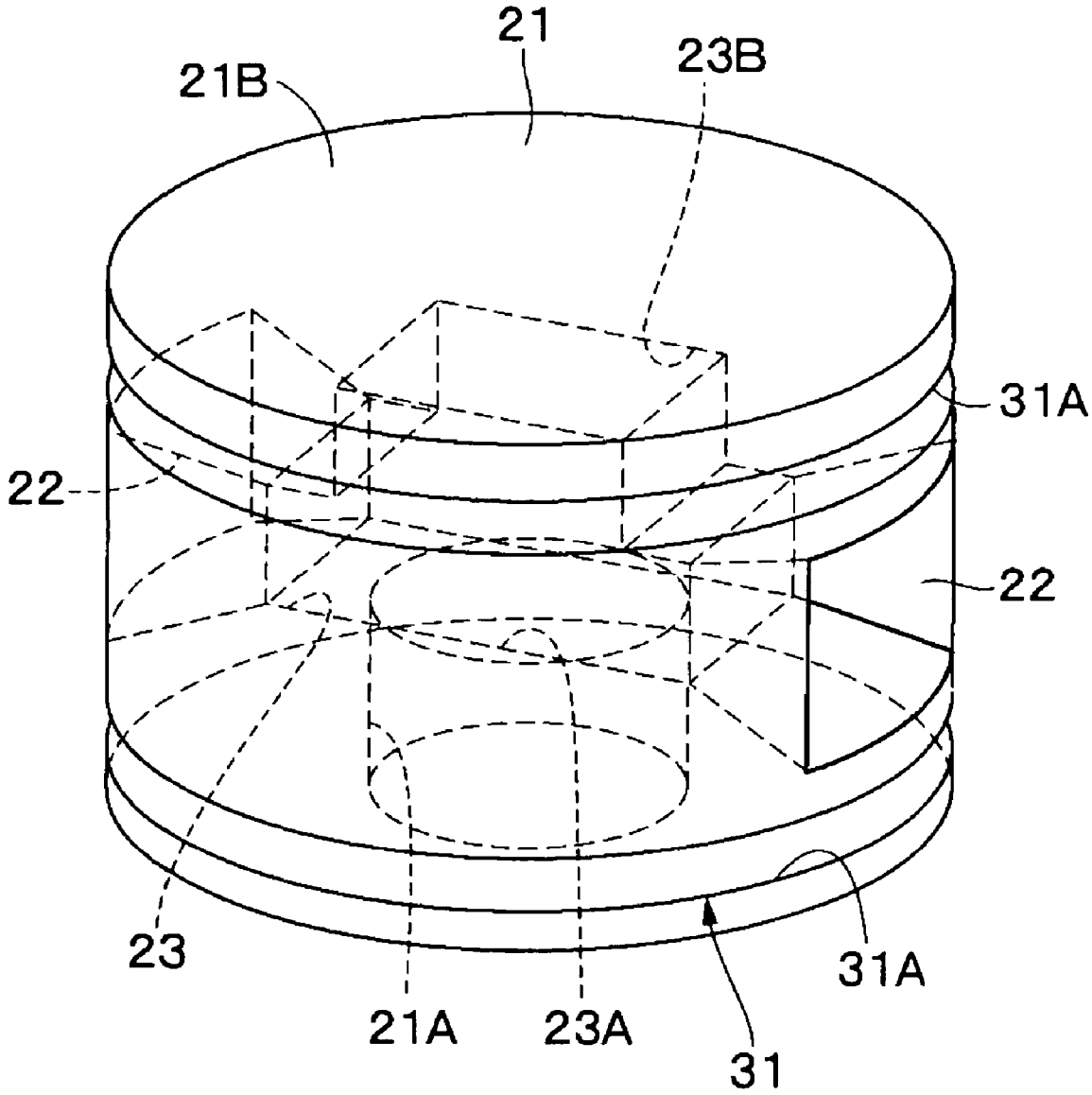
FIG. 18 is a perspective view of a rotation-side circular waveguide according to a second modification shown in a single unit.

According to the third preferred embodiment, the radiator-side chokes 24 are preferably provided on the external surface of the rotation-side circular waveguide 21 so as to surround the open end of the respective primary radiators 22. However, the present invention is not limited to this, so that two ring-shaped concave grooves 31A may also be formed to constitute radiator-side chokes 31 on the external surface of the rotation-side circular waveguide 21 above and below the two primary radiators 22 (on both sides in the axial direction) as in a second modification shown in FIG. 18.

Figure 19:
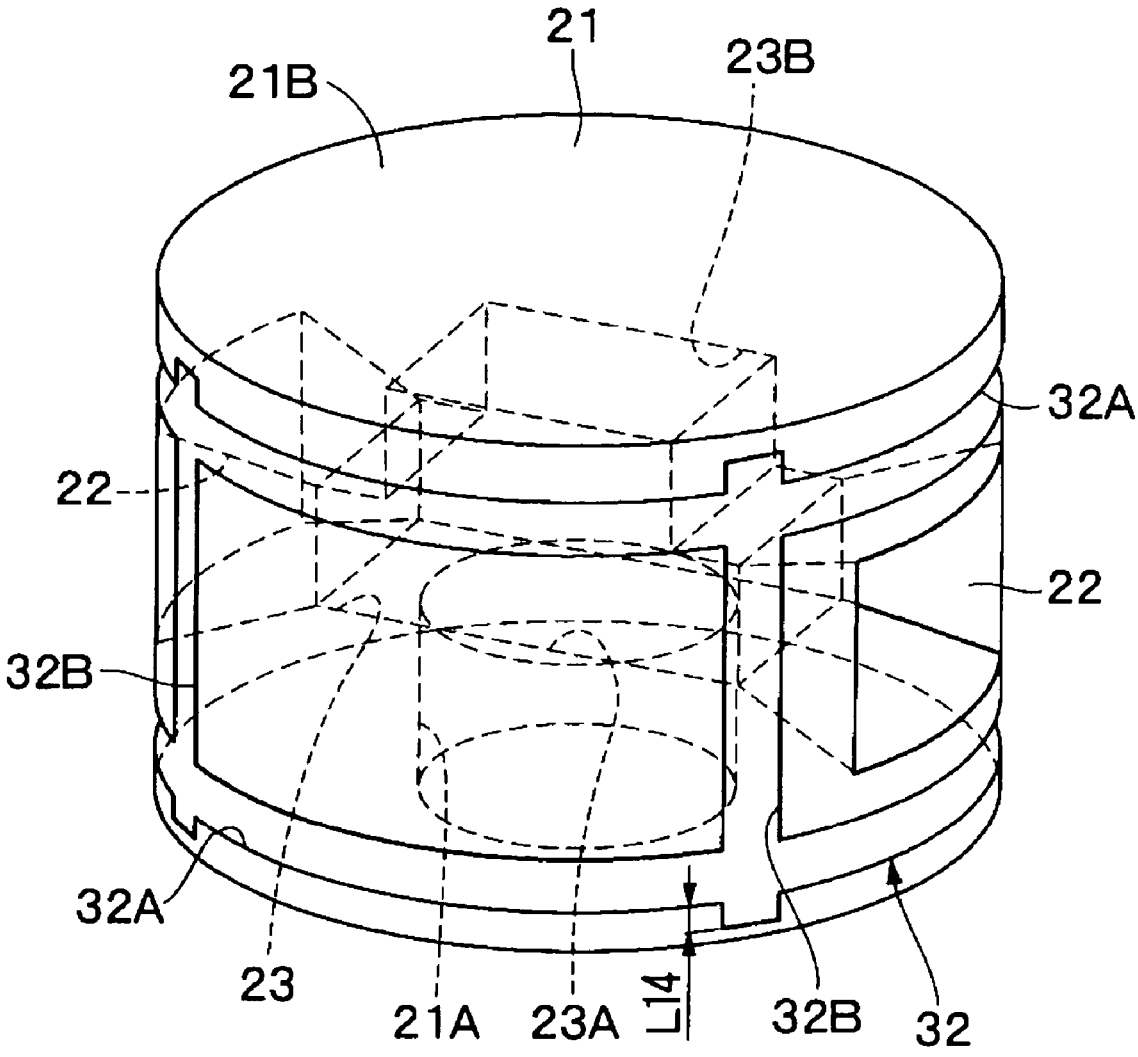
FIG. 19 is a perspective view of a rotation-side circular waveguide according to a third modification shown in a single unit.

As in a third modification shown in FIG. 19, two first ring-shaped concave grooves 32A may be formed on the external surface of the rotation-side circular waveguide 21 above and below the two primary radiators 22 (on both sides in the axial direction) while second straight concave grooves 32B intersecting with the first concave grooves 32A may be formed on the right and left of the primary radiators 22 (on both sides in the circumferential direction) so as to constitute radiator-side chokes 32 of the first and second concave grooves 32A and 32B. In this case, the protrusion length L14 of the second concave groove 32B from the first concave groove 32A may be about λ/4 (L14≈λ/4), where λ is the wavelength under vacuum at used frequency band.

Figure 20:
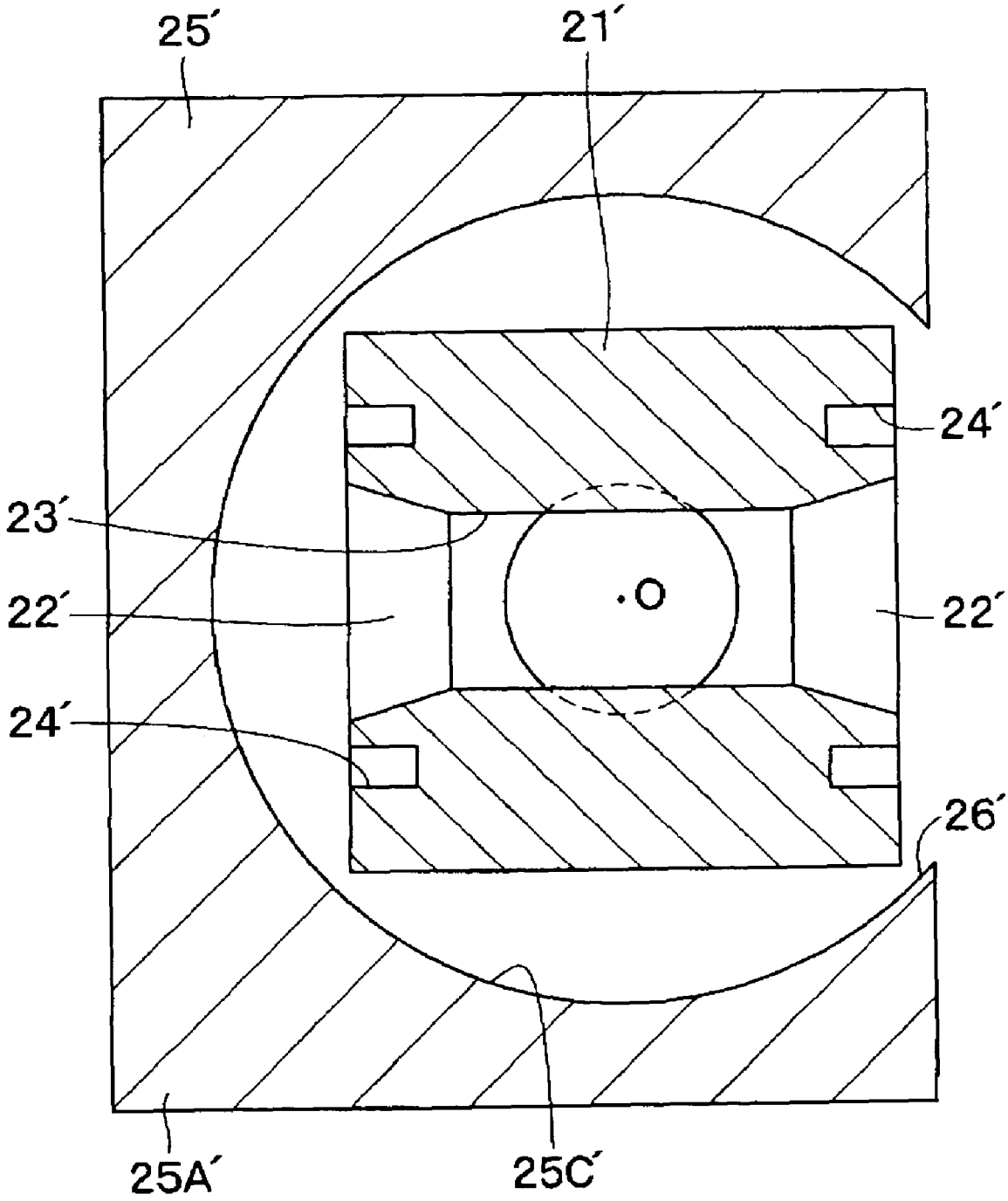
FIG. 20 is a cross-sectional view of a rotation-side circular waveguide and a casing according to a fourth modification at the same position as that of FIG. 16.

Moreover, according to the third preferred embodiment, the radiator-side chokes 24 are preferably provided on the external surface of the cylindrical rotation-side circular waveguide 21. However, the present invention is not limited to this, so that as in a fourth modification shown in FIG. 20, on one surface of a rotation-side circular waveguide 21' with a substantial cubic external shape, a primary radiator 22' may be opened while a radiator-side choke 24' may be formed on the same surface as the one on which the primary radiator 22' is opened. In this case, a casing 25' has an accommodation hole 25C' within which the rotation-side circular waveguide 21' having a substantially square section is rotatable. Thereby, the radiator-side choke 24' can be shaped on a plane so that fabrication of the radiator-side choke 24' is facilitated.

According to the third preferred embodiment, the radiator-side chokes 24 are preferably provided on the external surface of the rotation-side circular waveguide 21. Alternatively, they may be formed on the accommodation hole 25C of the casing 25 or may be formed on both the rotation-side circular waveguide 21 and the casing 25.

Figure 21:
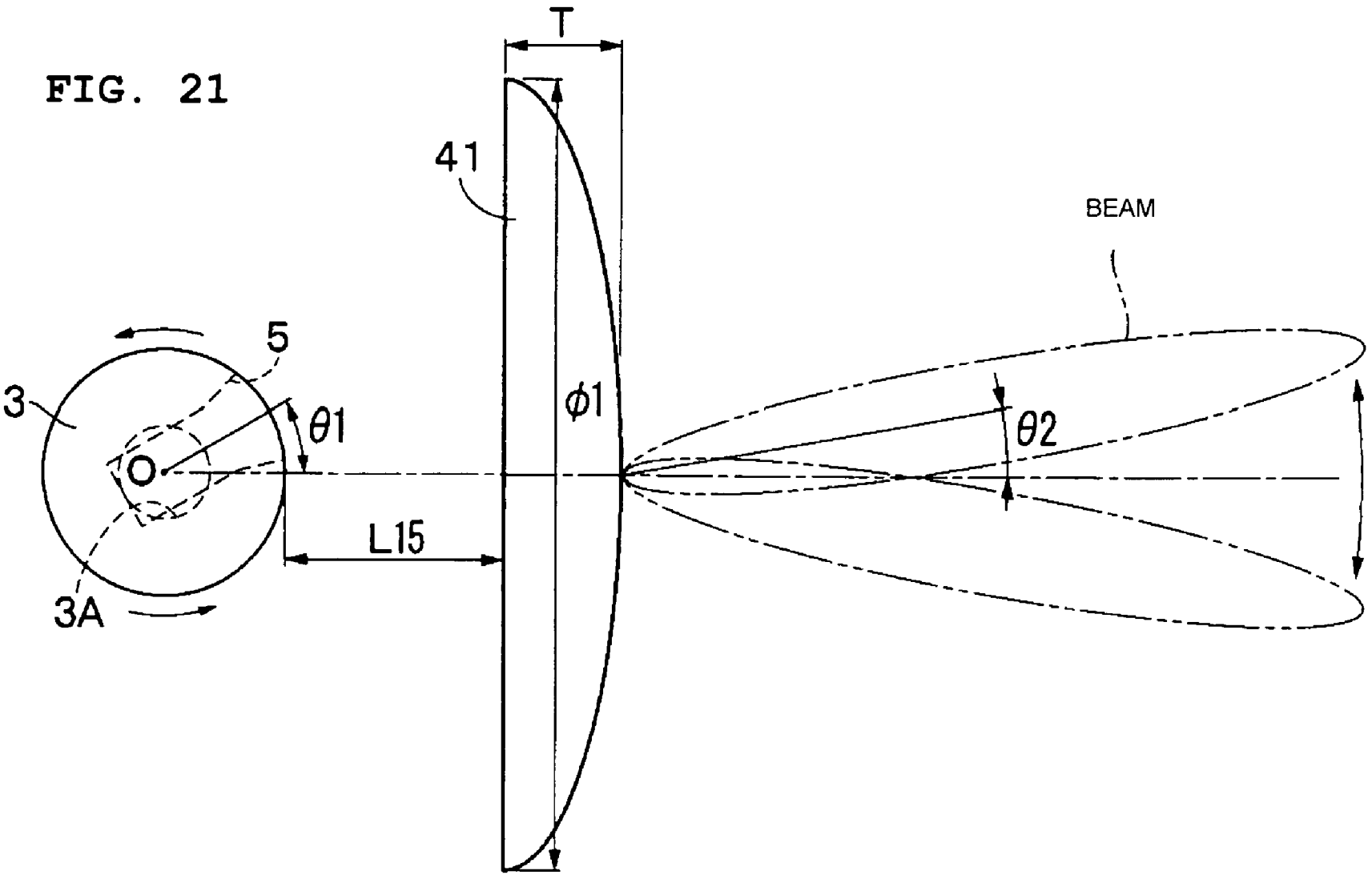
FIG. 21 is a plan view of an antenna apparatus according to a fourth preferred embodiment of the present invention.

Next, FIG. 21 shows an antenna apparatus according to a fourth preferred embodiment of the present invention. One of the unique features of the fourth preferred embodiment is that in the radiating direction of the primary radiator, a secondary radiator is provided, which can change the radiating direction in accordance with the incident position of high-frequency signals. In addition, according to the present preferred embodiment, like reference characters designate like components common to the first preferred embodiment and the description thereof is omitted.

Reference numeral 41 denotes a secondary radiator made of a dielectric lens with a diameter φ1 and a thickness T arranged on the line of the radiating direction of the primary radiator 5. The secondary radiator 41 is fixed in a state spaced from the rotation-side circular waveguide 3 by a distance L15.

Figure 22:
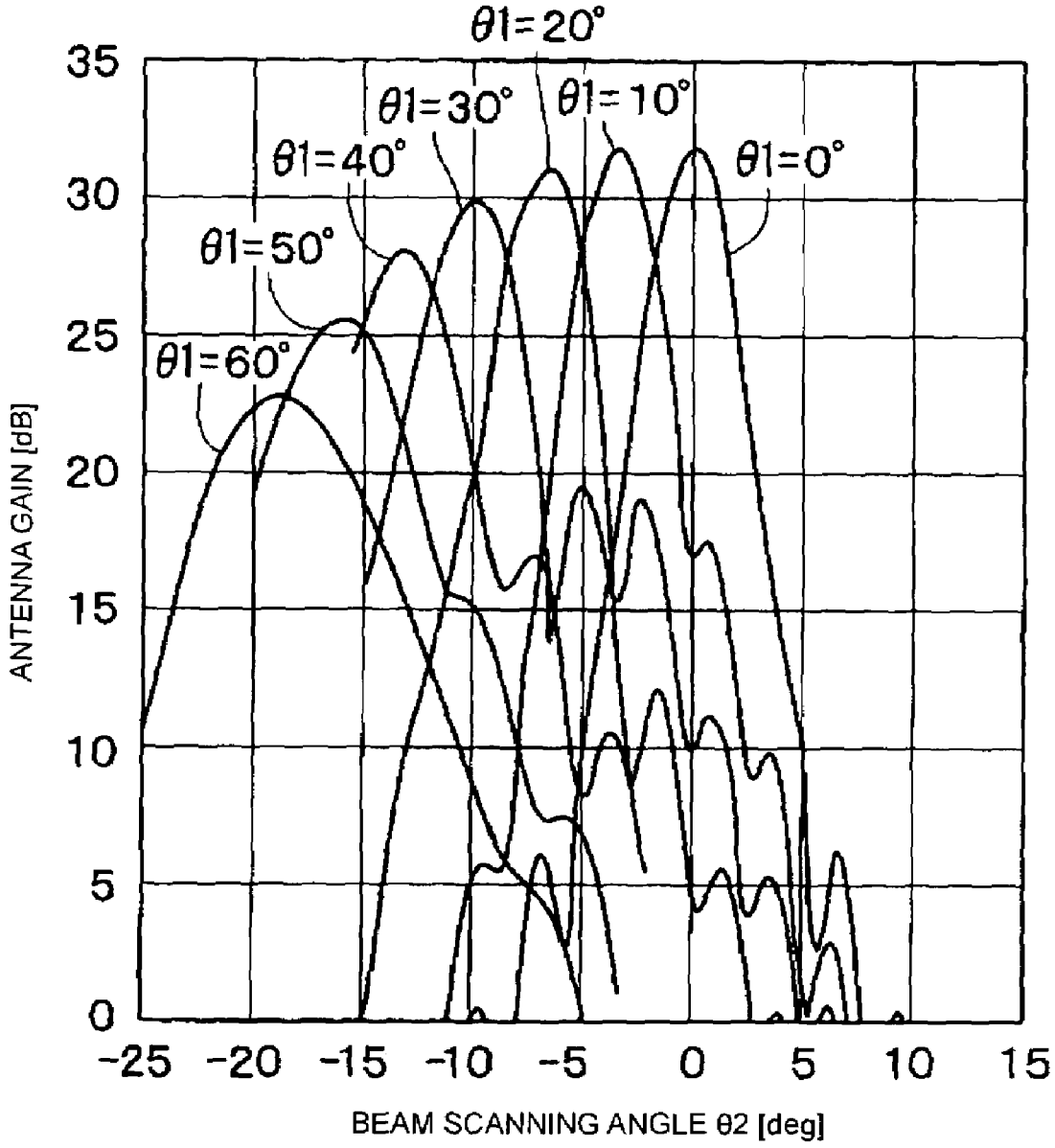
FIG. 22 is a characteristic diagram showing the relationship between the beam scanning angle and the antenna gain of the antenna apparatus shown in FIG. 21.

As an example, when the rotation-side circular waveguide 3 is rotated by a rotation angle θ1, the relationship between the scanning angle θ2 of the beam radiated from the secondary radiator 41 and the antenna gain is investigated. The results are shown in FIG. 22. Where, the diameter φ1 of the secondary radiator 41 is about 90 mm; the thickness T is about 18 mm; and the distance L15 is about 27 mm. The rotation angle θ1 is changed from 0° to 60°, as it is 0° when the primary radiator 5 approaches (faces) the secondary radiator 41 at most. As a result, when the rotation angle θ1 is changed in a range of −30° to +30° (θ1=−30° to +30°), the beam scanning angle θ2 can be changed from −10° to +10° (θ2=−10° to +10°) with the antenna gain obtained sufficiently, so that the apparatus is understood to be applicable to an ACC (adaptive cruise control) radar.

In such a manner, according to the present preferred embodiment, the same effects and advantages as those achieved by the first preferred embodiment can also be obtained. Moreover, since the secondary radiator 41 is provided on the line of the radiating direction, the incident position of high-frequency signals can be moved relative to the secondary radiator 41 by rotating the primary radiator 5 with the rotation-side circular waveguide 3 together so as to change an outgoing direction of the high-frequency signals emitted from the secondary radiator 41. As a result, scanning can be carried out laterally on a horizontal plane with the high-frequency signals, so that the apparatus can be applied to an ACC radar.

Figure 23:
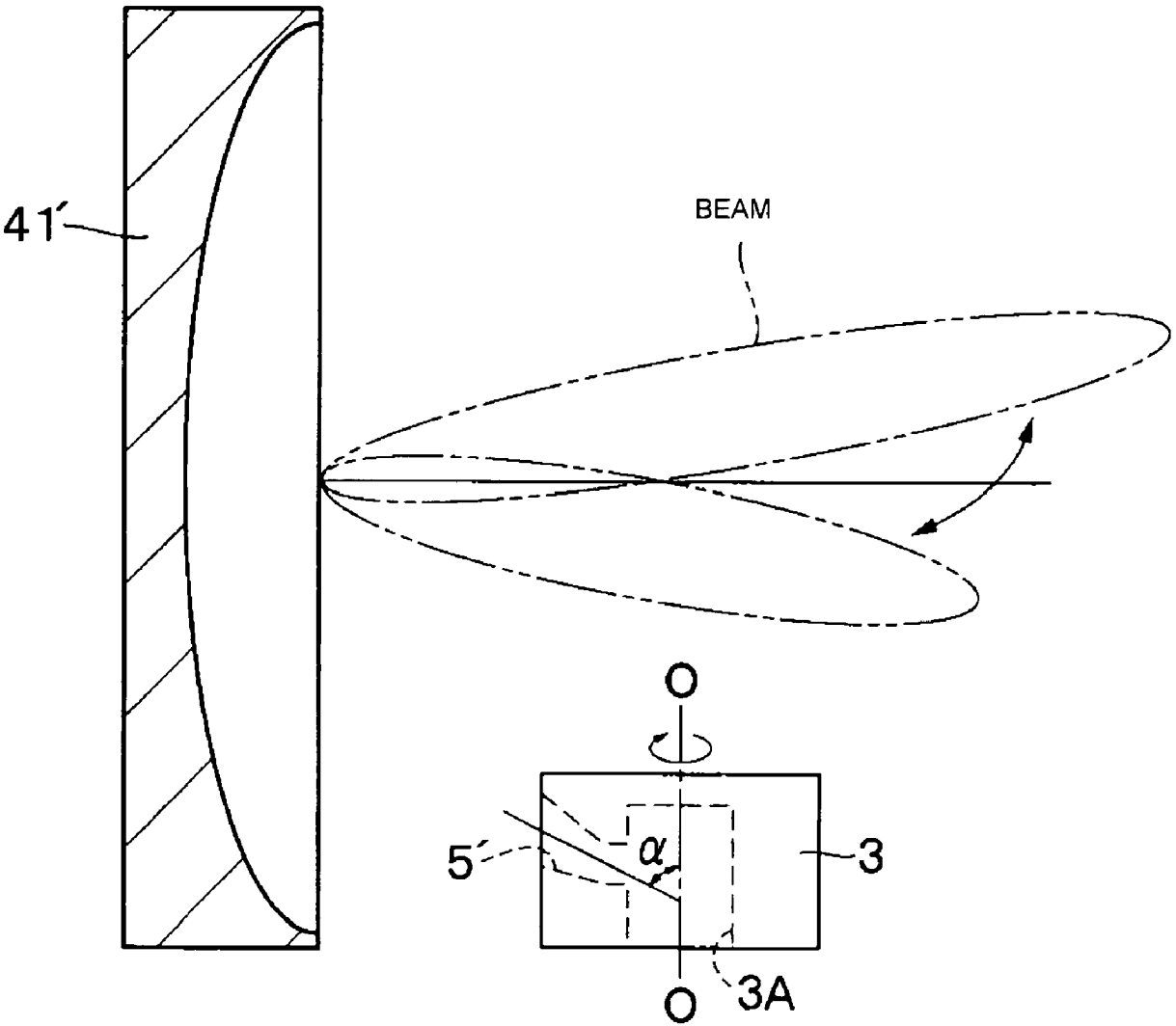
FIG. 23 is a sectional view of an antenna apparatus according to a fifth modification.

In addition, according to the fourth preferred embodiment, the dielectric lens is preferably used as the secondary radiator 41. Alternatively, as in a fifth modification shown in FIG. 23, a parabola reflector may be used as a secondary radiator 41'. In this case, when the radiating direction of a primary radiator 5' is inclined about the rotation axis of the rotation-side circular waveguide 3 by an angle α (α=10° to 80°, for example), the high-frequency signals can be rather easily entered into the secondary radiator 41'.

Figure 24:
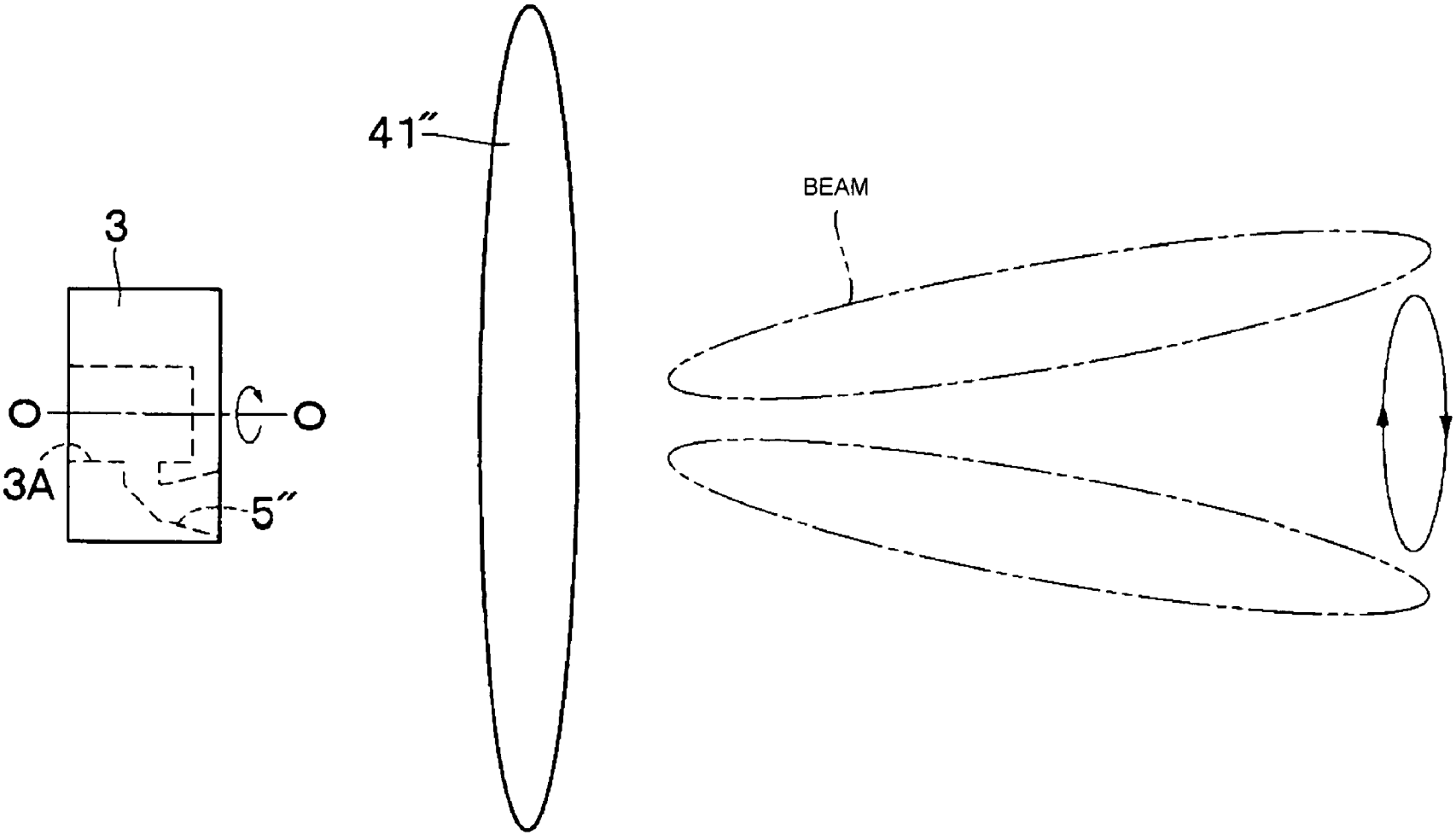
FIG. 24 is a plan view of an antenna apparatus according to a sixth modification.

Furthermore, according to the fourth preferred embodiment, the primary radiator 5 is preferably arranged in a direction that is different from that of the rotation axis of the rotation-side circular waveguide 3. Alternatively, as in a sixth modification shown in FIG. 24, a primary radiator 5" that is arranged in parallel with the rotation axis and not coaxially with the rotation axis may be used. In this case, by the secondary radiator, scanning can be performed with a beam, and when a secondary radiator 41" including a bifocal lens is used, scanning can be performed in a conical shape with a beam.

Figure 25:
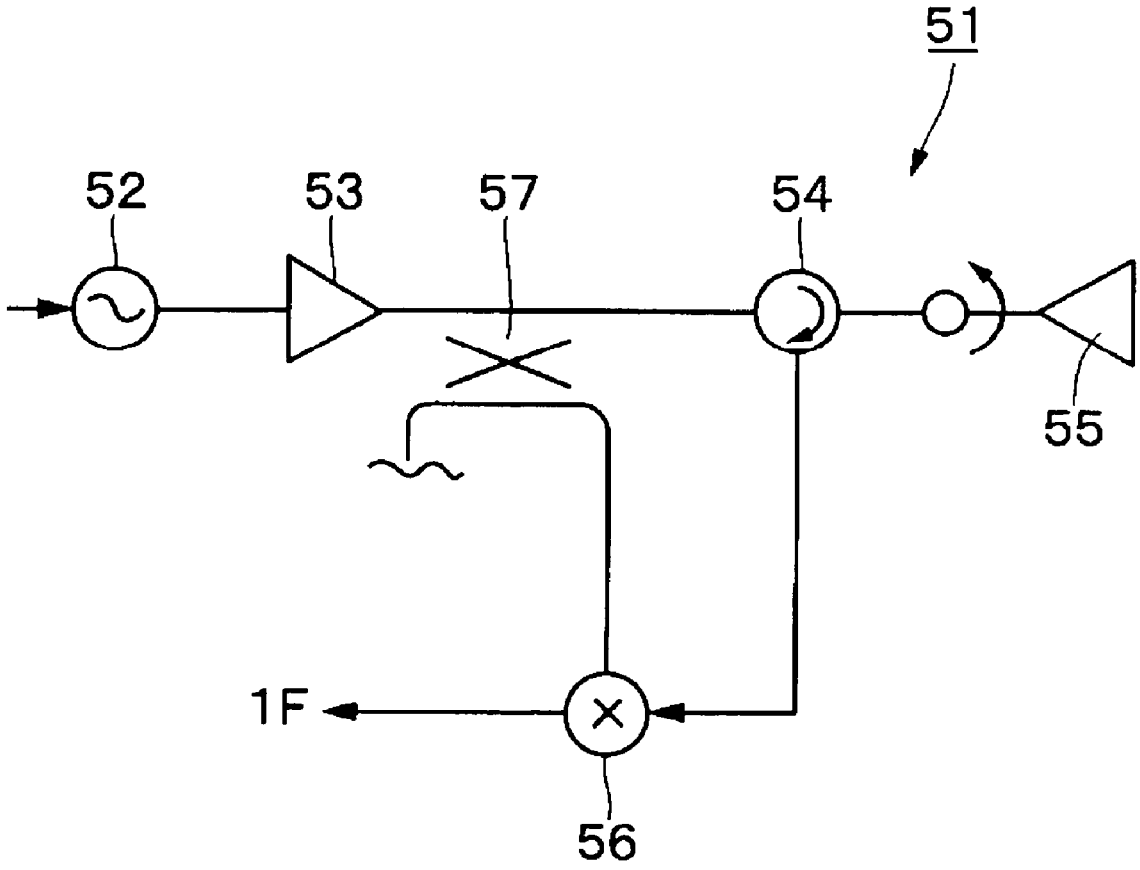
FIG. 25 is a block diagram of a radar according to a fifth preferred embodiment of the present invention.

Next, FIG. 25 shows a fifth preferred embodiment of the present invention. One of the unique features of the fifth preferred embodiment is that using the antenna apparatus according to various preferred embodiments of the present invention, a radar is constructed as a transmitter/receiver.

Reference numeral 51 denotes a radar, and the radar 51 preferably includes a voltage-controlled oscillator 52, an antenna apparatus 55 according to any of the first to fourth preferred embodiments and connected to the voltage-controlled oscillator 52 via an amplifier 53 and a circulator 54, and a mixer 56 connected to the circulator 54 for down-converting the signals received from the antenna apparatus 55 into intermediate-frequency signals IF. Between the amplifier 53 and the circulator 54, a directional coupler 57 is connected, and by the directional coupler 57, power-distributed signals are transmitted to the mixer 56 as local signals.

The radar according to the present preferred embodiment has the unique structure described above, and the oscillatory signal produced from the voltage-controlled oscillator 52 is amplified by the amplifier 53 and sent from the antenna apparatus 55 via the directional coupler 57 and the circulator 54 as a sending signal. On the other hand, the signal received from the antenna apparatus 55 is transmitted to the mixer 56 via the circulator 54 while being down-converted using the local signal from the directional coupler 57 so as to be produced as the intermediate-frequency signal IF.

In such a manner, according to the present preferred embodiment, since the radar is constructed using the antenna apparatus 55, by rotating the primary radiator of the antenna apparatus 55, high-frequency signals can be sent or received in all directions.

Figure 26:
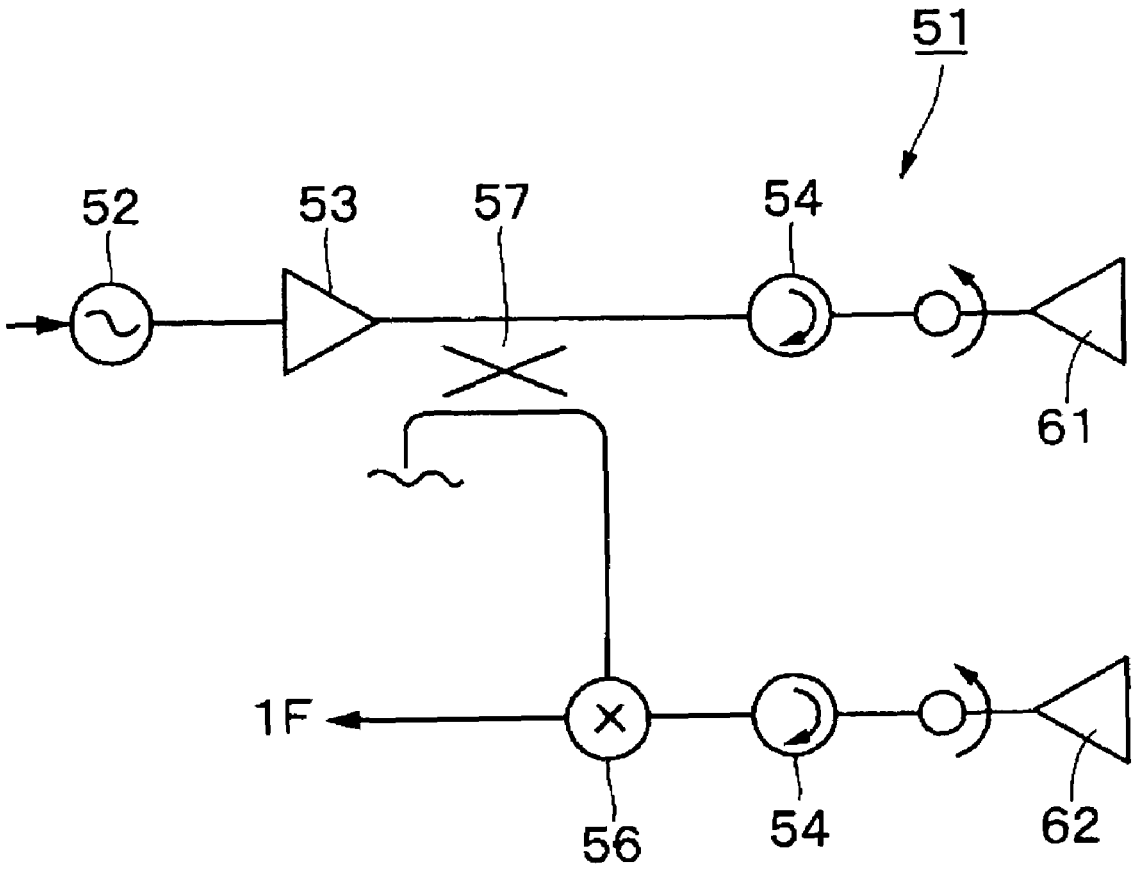
FIG. 26 is a block diagram of a radar according to a seventh modification.

In addition, according to the fifth preferred embodiment, the antenna apparatus 55 preferably has a structure sharing transmitting with receiving. Alternatively, like in a seventh modification shown in FIG. 26, a structure having a transmitting antenna apparatus 61 that is separate from a receiving antenna apparatus 62 may also be used.

According to the fifth preferred embodiment described above, the radar incorporates the antenna apparatus according to any of various preferred embodiments of the present invention. Alternatively, the antenna apparatus may be applied to a communication apparatus as a transmitter/receiver.

As is described in detail above, according to preferred embodiments of the present invention, the fixed-side transmission line is arranged coaxially with the rotation-side transmission line and both the lines have an axially symmetrical electric field distribution or magnetic field distribution, so that high-frequency signals in the same mode can be propagated through the fixed-side transmission line and the rotation-side transmission line regardless of the rotational displacement of the rotation-side transmission line. Between the fixed-side transmission line and the rotation-side transmission line, the transmission-line side choke is provided, so that both the lines can be choke-coupled together and short-circuited at a high-frequency using the transmission-line side choke so as to prevent the high-frequency signal from leaking from the gap between both the lines. Furthermore, the rotation-side transmission line is provided with the primary radiator radiating high-frequency signals in a direction different from the rotation axis, so that using the primary radiator, the high-frequency signal can be radiated in a direction such as a perpendicular direction and a direction inclined by a predetermined angle relative to the radiating direction of the rotation-side transmission line.

Since the primary radiator is constructed to rotate with the rotation-side transmission line together, while wide angle detection and high angular resolution can be achieved, the entire antenna apparatus structure is simplified, thereby reducing manufacturing cost. Since the primary radiator can be driven at a constant speed in a predetermined direction together with the rotation-side transmission line, the load of the primary radiator to the driving system can be reduced, thereby improving reliability and durability.

If a plurality of the primary radiators are provided in the rotation-side transmission line, and the plurality of the primary radiators are arranged to direct themselves in directions that are different from each other, when any primary radiators directed in a predetermined direction in the plurality of the rotating primary radiators are enabled to radiate signals while the residual primary radiators are blocked, in comparison with the single primary radiator attached thereto, a period of time of radiating the high-frequency signals in the predetermined direction within one revolution can be increased so as to increase the detection period and communication period.

Furthermore, when a casing is arranged around the plurality of the primary radiators for surrounding the primary radiators, and the casing is provided with a radiator opening formed thereon, to which any one of the plurality of rotating primary radiators is sequentially connected, in comparison with the single primary radiator attached thereto, a period of time of radiating the high-frequency signals through the radiator opening within one revolution of the rotation-side transmission line can be increased so as to increase the detection period and communication period.

Moreover, when a radiator-side choke is provided between the plurality of primary radiators and the casing, while one primary radiator is radiating high-frequency signals through the radiator opening, the high-frequency signals can be prevented from leaking through between the residual primary radiators and the casing, so that the loss of the entire antenna apparatus can be minimized.

Furthermore, when the rotation-side transmission line is provided with the primary radiator that is capable of radiating high-frequency signals in parallel with the rotation axis not coaxially with the rotation axis, the radiation position of the high-frequency signal can be moved about the rotation axis as a center by rotating the primary radiator together with the rotation-side transmission line. Thereby, by arranging the secondary radiator on the line of the radiating direction of the primary radiator, scanning can be carried out with a high-frequency signal beam, so that the antenna apparatus can be applied to an ACC radar.

Furthermore, when a secondary radiator, which changes an outgoing radiation direction in accordance with an incident position of high-frequency signals, is arranged on the line of the radiating direction of the primary radiator, by rotating the primary radiator together with the rotation-side transmission line, the incident position of high-frequency signals can be moved relative to the secondary radiator so as to change the outgoing direction of the high-frequency signal emitted from the secondary radiator. As a result, scanning can be carried out laterally on a horizontal plane or scanning can be performed in a conical shape with a beam.

Moreover, when the respective fixed-side transmission line and the rotation-side transmission line are made of a circular waveguide having a propagation mode in a TM01 mode, the fixed-side transmission line or the rotation-side transmission line can be easily connected to a rectangular waveguide in a TE10 mode, for example, so as to easily feed high-frequency signals to the fixed-side transmission line while the rotation-side transmission line can be readily connected to the primary radiator such as a horn antenna.

Furthermore, when a transmitter/receiver is constructed using the antenna apparatus according to various preferred embodiments of the present invention, the entire antenna apparatus structure is simplified so as to reduce manufacturing cost while the load to a driving system for the primary radiator is reduced, thereby improving reliability and durability.

As described above, in the antenna apparatus according to preferred embodiments of the present invention, while wide angle detection and high angular resolution can be achieved, the entire antenna apparatus structure is simplified so as to reduce manufacturing cost. Thus, the apparatus is suitable for use as a radar, for example, for scanning with high-frequency electromagnetic waves (high-frequency signals), such as micro waves and millimeter waves, over a predetermined angular range.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the invention which fall within the true spirit and scope of the invention.

The invention claimed is:

1. An antenna apparatus comprising:

a fixed-side transmission line having an electric field distribution or a magnetic field distribution that is axially symmetrical in a propagating direction;

a rotation-side transmission line, having an axially symmetrical electric field distribution or magnetic field distribution, arranged coaxially with the fixed-side transmission line so as to be rotatable about an axis of the fixed-side transmission line;

a transmission-line side choke disposed between the fixed-side transmission line and the rotation-side transmission line and arranged to cause a short-circuit between the fixed-side transmission line and the rotation-side transmission line at a high frequency; and a primary radiator disposed in the rotation-side transmission line so as to be rotatable together with the rotation-side transmission line for radiating high-frequency signals that have passed through the rotation-side transmission line in a direction that is different from that of a rotation axis of the rotation-side transmission line.

2. The apparatus according to claim 1, wherein a plurality of the primary radiators are provided in the rotation-side transmission line, and the plurality of the primary radiators are arranged to direct themselves in directions that are different from each other.

3. The apparatus according to claim 2, further comprising a casing arranged around the plurality of the primary radiators so as to surround the plurality of primary radiators, wherein the casing includes a radiator opening formed thereon and arranged such that any one of the plurality of rotating primary radiators can be sequentially connected to the radiator opening.

4. The apparatus according to claim 3, further comprising a radiator-side choke disposed between the plurality of primary radiators and the casing, wherein when one of the primary radiators is connected to the radiator opening, the other primary radiators and the casing are shorted therebetween by the radiator-side choke at high frequency.

5. The apparatus according to claim 1, further comprising a secondary radiator arranged on the line of the radiating direction of the primary radiator, the secondary radiator changing an outgoing radiation direction in accordance with an incident position of high-frequency signals.

6. The apparatus according to claim 5, wherein each of the fixed-side transmission line and the rotation-side transmission line includes a circular waveguide having a propagation mode in a TM01 mode as the magnetic field distribution that is axially symmetrical about the propagating direction.

7. A transmitter/receiver including the antenna apparatus according to claim 6.

8. A transmitter/receiver including the antenna apparatus according to claim 5.

9. The apparatus according to claim 1, wherein each of the fixed-side transmission line and the rotation-side transmission line includes a circular waveguide having a propagation mode in a TM01 mode as the magnetic field distribution that is axially symmetrical about the propagating direction.

10. A transmitter/receiver including the antenna apparatus according to claim 1.

11. An antenna apparatus comprising:

a fixed-side transmission line having an electric field distribution or a magnetic field distribution that is axially symmetrical in a propagating direction;

a rotation-side transmission line, having an axially symmetrical electric field distribution or magnetic field distribution, arranged coaxially with the fixed-side transmission line so as to be rotatable about an axis of the fixed-side transmission line;

a transmission-line side choke disposed between the fixed-side transmission line and the rotation-side transmission line and arranged to cause a short-circuit between the fixed-side transmission line and the rotation-side transmission line at a high frequency; and a primary radiator disposed in the rotation-side transmission line so as to be rotatable together with the rotation-side transmission line for radiating high-frequency signals that have passed through the rotation-side transmission line in parallel with a rotation axis of the rotation-side transmission line in a manner that is not coaxial with the rotation axis.

12. The apparatus according to claim 11, further comprising a secondary radiator arranged on the line of the radiating direction of the primary radiator, the secondary radiator changing an outgoing radiation direction in accordance with an incident position of high-frequency signals.

13. The apparatus according to claim 12, wherein each of the fixed-side transmission line and the rotation-side transmission line includes a circular waveguide having a propagation mode in a TM01 mode as the magnetic field distribution axially symmetrical about the propagating direction.

14. A transmitter/receiver including the antenna apparatus according to claim 12.

15. The apparatus according to claim 11, wherein each of the fixed-side transmission line and the rotation-side transmission line includes a circular waveguide having a propagation mode in a TM01 mode as the magnetic field distribution axially symmetrical about the propagating direction.

16. A transmitter/receiver including the antenna apparatus according to claim 15.

17. A transmitter/receiver including the antenna apparatus according to claim 11.

* * * * *